US005653200A

United States Patent [19]

Hafner et al.

[11] Patent Number: 5,653,200

[45] Date of Patent: Aug. 5, 1997

[54] INTERNAL COMBUSTION ENGINE WITH INTAKE MODULE OR INTAKE TUBE FASTENED TO IT, AND METHOD FOR FASTENING AN INTAKE MODULE OR INTAKE TUBE TO AN INTERNAL COMBUSTION ENGINE

[75] Inventors: Udo Hafner, Ludwigsburg; Walter Lorch, Zaberfeld; Eckhard Bodenhausen, Steinheim; Hans-Dieter Siems, Eberdingen; Thomas Gregorius, Grossbottwar; Werner Haarer, Sersheim; Albert Staacke, Murr; Uwe Schopper, Tamm; Bernd Koch, Oberriexingen, all of Germany

[73] Assignee: Robert Bosch GmbH, Stuttgart, Germany

[21] Appl. No.: 688,780

[22] Filed: Jul. 31, 1996

[30] Foreign Application Priority Data

Jul. 31, 1995 [DE] Germany ..... 195 28 047.4

[51] Int. Cl.[6] ..... F02M 35/10

[52] U.S. Cl. ..... 123/184.21; 123/184.61

[58] Field of Search ..... 123/184.21, 184.61, 123/195 A

[56] References Cited

U.S. PATENT DOCUMENTS

| | | | |
|---|---|---|---|
| 3,782,343 | 1/1974 | Notaras et al. | 123/184.21 |
| 5,065,708 | 11/1991 | Wehle et al. | 123/184.61 |
| 5,150,669 | 9/1992 | Rush, II et al. | 123/184.53 |
| 5,235,938 | 8/1993 | Haussmann et al. | 123/184.21 |
| 5,474,039 | 12/1995 | Doragrip | 123/184.55 |
| 5,501,075 | 3/1996 | Spies et al. | 123/184.21 |

FOREIGN PATENT DOCUMENTS

| | | | |
|---|---|---|---|
| 2262294 | 6/1974 | Germany | 123/184.61 |
| 2824205 | 12/1979 | Germany | 123/184.21 |
| 5-312045 | 11/1993 | Japan | 123/184.21 |

*Primary Examiner*—David A. Okonsky

*Attorney, Agent, or Firm*—Edwin E. Greigg; Ronald E. Greigg

[57] ABSTRACT

The invention joins the intake module or intake tube to the engine with the aid of a displaceable retaining element. The retaining element, which in the mounted state is under initial tension, is braced against an engine retention face associated with the engine and against at least one counterpart intake module retention face joined to the intake module or intake tube. Because of the displaceability of the retaining element, the expense and effort of mounting and dismantling the intake module or intake tube to the engine by screws are substantially reduced. The engine is intended in particular for motor vehicles.

17 Claims, 27 Drawing Sheets

INTERNAL COMBUSTION ENGINE WITH INTAKE MODULE OR INTAKE TUBE FASTENED TO IT, AND METHOD FOR FASTENING AN INTAKE MODULE OR INTAKE TUBE TO AN INTERNAL COMBUSTION ENGINE

BACKGROUND OF THE INVENTION

The invention is based on an internal combustion engine having an intake module or intake tube fastened to the engine, and a method for fastening an intake module to an engine as generically defined hereinafter.

Internal combustion engines to which air or a fuel-air mixture is supplied via an intake tube exist. A fastening means holds the intake tube or intake module against the engine in a retention direction. In the known embodiments, the fastening means includes a plurality of fastening screws, with which the intake tube is held against the engine, and especially against a cylinder head of the engine. For mounting the intake module or intake tube on the engine or for dismantling it from the engine, the heads of the fastening screws must be accessible to a suitable turning tool. The cylinder head closes off a crankcase or cylinder tube of the engine from the top and receives gas exchange devices, for instance. Moreover, together with a piston of the engine, it forms a desired combustion chamber shape. In internal combustion engines typical for passenger cars, usually one cylinder head is used for all the cylinders of the engine.

In modern internal combustion engines, an increasing number of additional components are connected to the intake tube. The components include for instance a throttle device, a control unit, a pressure sensor, a temperature sensor, an injection valve, a fuel distributor element, an ignition coil, a tank venting valve, and other final control elements, sensors, cables, hoses and so forth. There may even be multiple examples of these components provided on one intake tube. The intake tube, together with the components mounted on it or integrated with it is often referred to as an intake module. Since a not-inconsiderable number of different components is mounted on the intake tube of the intake module, the intake module is often relatively bulky, which makes for poorer accessibility to the fastening screws. It is often necessary for the intake tube to be firmly screwed to the cylinder head of the engine first by the fastening screws, before the other components can be fastened to the intake tube. As a result, it is not possible to keep the intake module on hand, complete with all its components assembled, for fastening to the engine. Testing of the complete intake module before it is mounted on the engine is also almost impossible.

Since the fastening screws are often not accessible once the intake module has been fully assembled, removal of the intake tube from the engine first requires that at least some of the components of the intake module must first be removed from the intake tube, before the fastening screws that hold the intake tube on the engine become accessible.

Often the intake tube itself is also already quite bulky and complicated in shape. Therefore even if only the intake tube, without additional components, is to be fastened to the engine, access to the fastening screws is often considerably more difficult, and the engineer is quite limited in terms of designing the intake tube.

ADVANTAGES OF THE INVENTION

The internal combustion engine according to the invention with the intake module or intake tube fastened to it, and the method of the invention as defined herein offer the substantial advantage that the fastening means that holds the intake tube or intake module on the engine can be embodied with the retaining element in such a way that even if space is tight for installation, the intake tube can be mounted in a simple way on the engine or removed from the engine, preferably together with all its components or together with substantial components of the intake module.

The fastening means having the at least one retaining element can advantageously be designed very simply in such a way that unintentional loosening is impossible.

Advantageous further features of and improvements to the internal combustion engine with the intake tube fastened to it, and to the method are possible with the provisions recited herein.

If the at least one retaining element is supported on a plurality of retention faces (engine retention faces) and/or a plurality of counterpart retention faces (intake module retention faces), then the result is a distribution of the force to be transmitted between the intake module and the engine and hence improved advantageous fastening of the intake module or intake tube to the engine is accomplished.

If the fastening means is designed such that the retaining element is coupled to either the engine or the intake module or intake tube even before the intake module or intake tube is joined to the engine or even if the intake module or intake tube has been removed from the engine, then this offers the advantage that the retaining element cannot be lost. If the retaining element is fastened to the intake module or intake tube, this offers the additional advantage that the retaining element together with the intake module or intake tube and the other components can form a preassembled component unit.

The manufacture of the internal combustion engine or of its cylinder head becomes simpler if the retention face (engine retention face), if the retention face (engine retention face) is provided on a stop piece connected to the engine (engine stop piece). Corresponding advantages are obtained in the same way if the counterpart retention face (intake module retention face) is provided on a counterpart stop piece (intake module stop piece) connected to the intake module or intake tube. An especially simple production version is additionally obtained if the stop piece or counterpart stop piece is embodied as a bolt or stay bolt.

Because of the chamfer on the engine or on the cylinder head and/or on the intake module or intake tube and/or on the retaining element, the advantage is obtained that the spring force or an initial tension can be generated by simply displacing the retaining element.

The invention will be better understood and further objects and advantages thereof will become more apparent from the ensuing detailed description of preferred embodiments taken in conjunction with the drawings.

DESCRIPTION OF THE PREFERRED EMBODIMENTS

The internal combustion engine is for instance an engine to which air or a fuel-air mixture is supplied via an intake tube. The intake tube can be combined with various other components to form a so-called intake module. The other components may for instance be elements needed for gasoline injection, as well as various final control elements, sensors, cables and the hoses. The components may in particular be a throttle valve of a throttle device, a control unit, a pressure sensor, a temperature sensor, an injection valve, a fuel distributor element, an ignition coil, a tank venting valve, and so forth. Depending on the number of cylinders of the engine, these components are available in correspondingly required numbers.

Combining the intake tube with the various components to form an intake module offers the advantage that the intake module can be prepared and optionally tested complete, before it is sent on for mounting to the engine.

The region of the engine on which the intake module is normally fastened is often called the cylinder head.

In the exemplary embodiments described below, an intake module is fastened to the engine; the intake module has an intake tube braced on the engine. This is merely one example. It is also possible for the intake module to be supported on the engine not via the intake tube but rather via some other suitable component.

Although the advantages of the invention become especially important when intake modules of extensive design are involved, it should be noted that the invention can advantageously be employed even if instead of an intake module only an intake tube is to be fastened to the engine.

Figure 1:
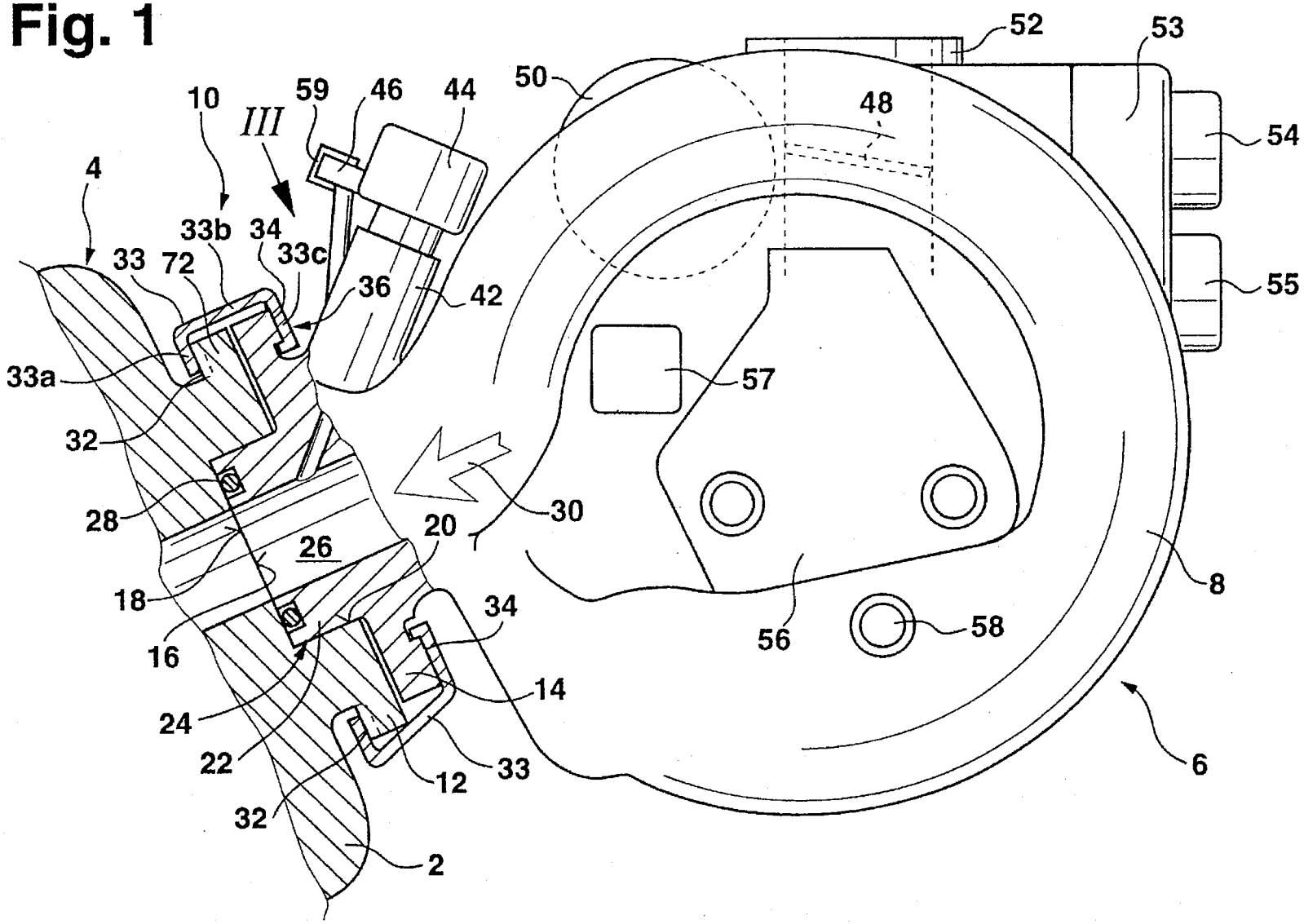
FIGS. 1–28 show variously embodied, especially advantageous, selected exemplary embodiments in general form, or details of various exemplary embodiments, or details of the engine or cylinder head with the intake module or intake tube fastened to it.

FIG. 1 shows a first exemplary embodiment.

FIG. 1, in section, shows a portion of a cylinder head 2 of an internal combustion engine 4. FIG. 1 also shows an intake module 6. The intake module 6 includes an intake tube 8.

The intake module 6 is fastened to the cylinder head 2 of the engine 4 with the aid of a fastening means 10.

There is a flange 12 on the cylinder head 2, and there is a flange 14 on the intake module 6 or on the intake tube 8. A flange face 16 is provided on the cylinder head 2 of the engine 4, and a flange face 18 is provided on the intake tube 8 of the intake module 6.

In the case of the intake module 6 mounted on the engine 4, the two flange faces 16, 18 are in mutual contact, with initial tension.

A turned groove 20 is provided in the region of the flange 12. There is a protrusion 22 on the intake tube 8 in the region of the flange 14. The protrusion 22 engages the turned groove 20 in such a way that a guide 24 is created, which prevents the intake module 6 from being capable of shifting relative to the engine 4 parallel to the flange faces 16, 18. The guide 24 allows a motion of the intake module 6 relative to the engine 4 only at right angles to the flange faces 16, 18. This direction is represented by an arrow marked 30 in the drawing and will hereinafter be called the retention direction 30.

The turned groove 20 and the protrusion 22 are not absolutely necessary. The guide 24 may also be omitted. The flange faces 16 and 18 may also be disposed such that together with the flanges 12 and 14, respectively, flat faces are created. Optionally, a fixation pin may be provided, which assures centering during mounting of the intake module 6 onto the engine 4.

An intake conduit 26 extends through the intake tube 8. The intake conduit 26 extends through the flange faces 16, 18 and continues on the far side of them in the cylinder head 2. In the region of the flange faces 16, 18, a seal 28 is provided. The seal 28 surrounds the intake conduit 26 and seals off the intake conduit 26 from the outside.

The fastening means 10 holds the intake module 6 in the direction of the arrow 30, that is, in the retention direction 30, against the cylinder head 2 of the engine 4.

In the exemplary embodiment shown in FIG. 1, the fastening means 10 includes a retention face 32, a retaining element 33, and a counterpart retention face 34. On the opposite side of the intake conduit 26, there are also a further retention face 32, a further retaining element 33, and a further counterpart retention face 34. These elements are likewise components of the fastening means 10. For the sake of easy and rapid association in the mind as one reads the description of the exemplary embodiments, the retention face 32 will hereinafter usually be called the engine retention face 32 and the counterpart retention face 34 will usually be called the intake module retention face 34.

The engine retention face 32 is located directly on the cylinder head 2 of the engine 4. The invention may also be embodied such that the engine retention face 32 is joined indirectly to the engine 4 with suitable adapters. In the exemplary embodiment shown, the intake module retention face 34 is located directly on the intake module 6. However, it is also possible to embody the invention such that the intake module retention face 34 is connected indirectly to the intake module 6 via suitable adapters.

Figure 2:
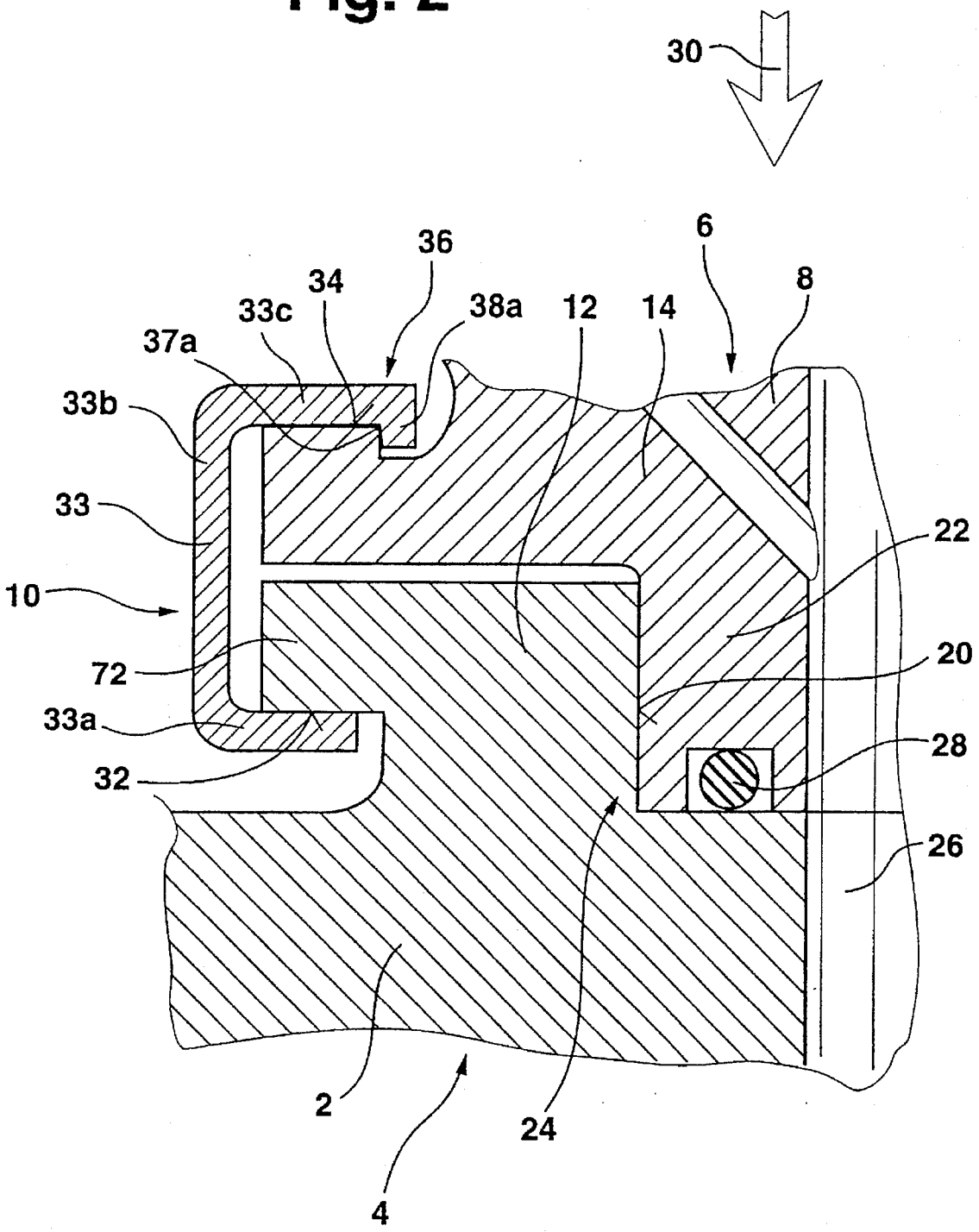

FIG. 2 shows a detail of the view shown in FIG. 1. For the sake of drawing simplicity, a different scale has been chosen for FIG. 2.

In all the drawings, identical parts or those that function identically are provided with the same reference numerals.

The retaining element 33 is an elongated structure, whose U-shaped cross section is shown in FIGS. 1 and 2. The cross section of the retaining element 33 can also be called bracketlike. The cross section of the retaining element 33 can be divided in approximate terms into a lower leg **33*a*, a bridge 33*b*, and an upper leg 33*c*. The end of the leg 33*c* remote from the bridge 33*b* is shaped in such a way, and the flange 14 of the intake module 6 is shaped in such a way in this region that a securing means 36 is formed here (FIG. 2). To form the securing means 36, a retention edge 37*a*, extending perpendicular to the plane of the drawing in FIG. 1, is located on the intake module 6, and a retention protrusion 38*a* extending at right angles to the plane of the drawing is located on the retaining element 33**.

The retention edge **37*a* and the retention protrusion 38*a* which form the securing means 36, are adapted to one another in such a way that the retaining element 33 cannot slip away from the engine retention face 32 and intake module retention face 34; instead, even under the influence of extreme oscillations, it is assured that the intake module 6 will be securely held in the retention direction 30 against the engine 4**.

Figure 3:
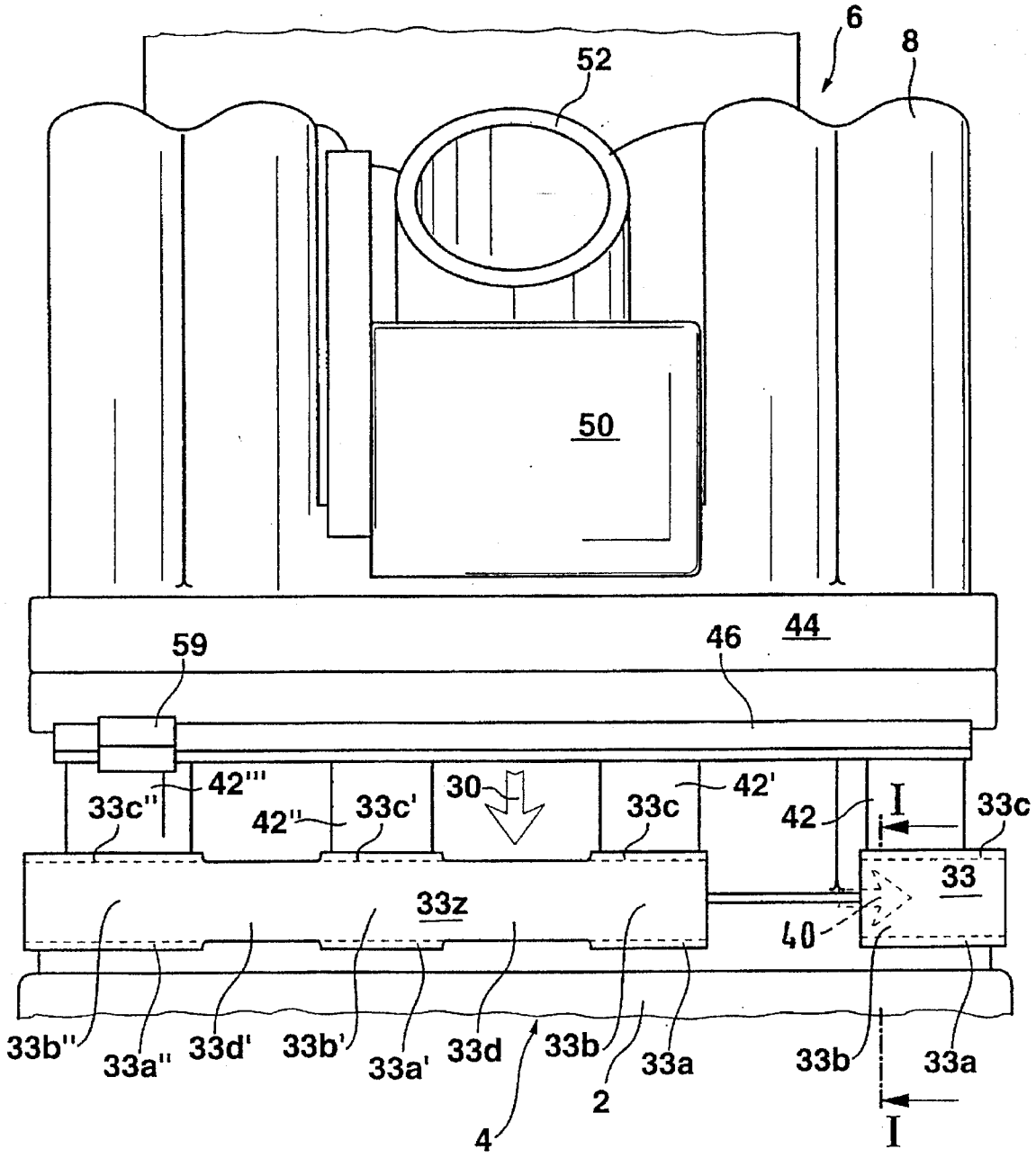

FIG. 3 shows a view on the long side of the first exemplary embodiment, which is seen in an end view in FIG. 1.

An arrow III is shown in FIG. 1. FIG. 3 shows the engine 4 with the intake module 6 mounted on it, looking in the direction of the arrow III.

In FIG. 3, the retaining element 33 and a further cohesive retaining element **33*z* can be seen. It is apparent that the retaining element 33*z* is an elongated strip. The cross section of the cohesive retaining element 33*z* is substantially equivalent to the cross section of the retaining element 33, except for the differences noted, so that the figures that show the retaining element in cross section in the drawing apply to both the retaining element 33 and the cohesive retaining element 33*z*. The retaining element 33*z* is subdivided longitudinally into one region having the leg 33***a*, the bridge 33*b* and the leg 33*c*, one region having a leg 33*a*', a bridge 33*b*' and a leg 33*c*', and one region having a leg 33*a*", bridge 33*b*" and leg 33*c*". There is a transitional region 33*d* between the bridge 33*b* and the bridge 33*b*' in the retaining element 33*z*. Correspondingly there is a transitional region 33*d*' between the bridges 33*b*' and 33*b*". The legs are interrupted at the transitional regions 33*d*, 33*d*'. The cross section of the cohesive retaining element 33*z* in the region of the legs is the same as the cross section of the retaining element 33 shown in FIGS. 1 and 2.

In FIG. 3, there is an arrow shown in dashed lines and identified by reference numeral 40. The direction of this arrow 40 will hereinafter be called the closing direction 40.

FIG. 3 shows the retaining element 33 and the retaining element 33*z* in the fully mounted state. If the retaining elements 33 and 33*z* are displaced counter to the arrow 40, then the fixed mechanical connection between the intake module 6 and the engine 4 opens. On displacement of the retaining elements 33 and 33*z* in the closing direction 40 represented by the arrow, the intake module 6 is pressed in the retention direction 30 mechanically firmly against the engine 4 (arrow 30 in FIGS. 1 and 3).

In the exemplary embodiment shown in FIGS. 1 and 3, the intake module 6 includes the intake tube 8, four injection valves 42, 42', 42", 42'", a fuel distributor element 44, an electrical multipoint plug 46, a throttle valve 48 shown in dashed lines, an actuator 50, an air filter connection 52, an electric control unit 53, a plug connection 54, a plug connection 55, an ignition distributor 56, two sensors 57, 58, and a plug connection 59. The intake module 6 also includes other additional parts and lengths of cable, but for the sake of simplicity they have not been shown in the drawing.

The intake tube 8, together with the parts 42–59, forms one complete component unit. This component unit is called the intake module 6. The parts 42–59 are screwed or clipped to the intake tube 8 or formed onto it, or are made together with the intake tube 8 in a single joint injection molding operation.

Since the intake module 6 includes a not-inconsiderable number of components, the intake module 6 is relatively bulky. Since the fastening means 10 which holds the intake module 6 on the engine 4 does not, in accordance with the present invention, at least at those points where otherwise accessibility for tightening or loosening a fastening screw would be problematic, include any fastening screw that would have to be tightened during mounting of the intake module 6 on the engine 4 or loosened in the event of dismantling, no care to assure accessibility of any fastening screws at all needs to be taken when designing the shape of the intake module 6 or intake tube 8.

Figure 4:
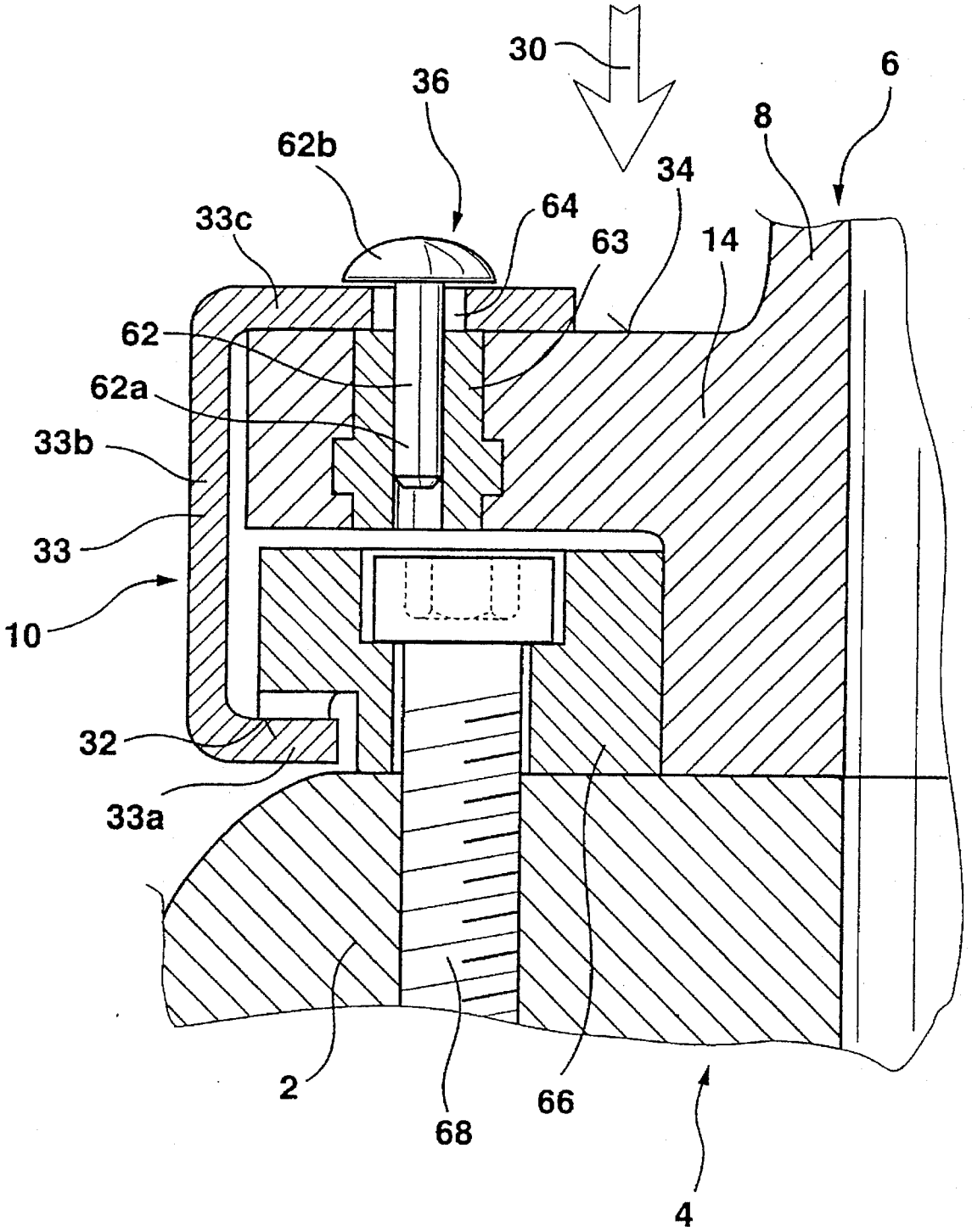

FIG. 4 shows as an example, on a different scale, a detail of another advantageous exemplary embodiment that is modified over that of FIG. 1. Those elements not shown in FIG. 4 correspond to the elements shown in FIG. 1.

Unless noted to the contrary or shown in the drawing, whatever is described and shown in conjunction with one of the drawing figures applied to the other exemplary embodiments as well. Unless the description says something to the contrary, details of the various exemplary embodiments can be combined with one another.

In the exemplary embodiment shown in FIG. 4, the securing means 36 substantially comprises a pin 62, firmly anchored in the flange 14 of the intake module 6, and a securing slit 64 in the leg 33*c* of the retaining element 33. Since the flange 14 is for instance of plastic, a tube 63 is embedded in the plastic and the pin 62 is anchored in it. The tube 63 may also be omitted and the pin 62 can be injection molded directly onto the intake tube 8, for instance. The pin 62 has a shaft 62*a* and a head 62*b*. The securing slit 64 is an oblong slot and is dimensioned, together with the head 62*b* of the pin 62, such that even if the intake module 6 is removed from the engine 4, the retaining element 33 or 33*z* is and remains coupled to the intake module 6. The head 62*b* assures that the retaining element 33 or 33*z* cannot fall off the intake module 6. The securing slit 64 is long enough that the retaining element 33 can be displaced to the requisite extent in the closing direction 40 (FIG. 3) or counter to the closing direction 40.

The at least one retention face 32, also called the engine retention face 32, may for instance be provided directly on the engine 4 or on the cylinder head 2 of the engine (FIGS. 1 and 2). Alternatively, the engine retention face 32 can also be provided on a stop piece 66 joined to the engine 4, which is also known as the engine stop piece 66. As FIG. 4 shows, the engine stop piece 66 is screwed firmly to the cylinder head 2, for instance by one or more screws 68. Since engine stop piece 66 can be screwed to the cylinder head 2 before the intake module 6 is joined to the engine 4, there is unhindered access for inserting the screw 68 and screwing it in place. The screw 68 may instead be firmly glued in place, for instance, or fastened by some other rotation-preventing means against loosening or turning loose, without hindrance to the ability to remove the intake module 6 from the engine 4. Thus securing the screw 68 assures that the intake module 6 will not separate unintentionally from the engine 4.

In the exemplary embodiments shown in FIGS. 1–4, the counterpart retention face 34, also known as the intake module retention face 34, which is acted upon by the leg 33*c* of the retaining element 33 in the retention direction 30, is located directly on the intake tube 8, which for instance comprises a single piece of cast plastic.

Figure 5:
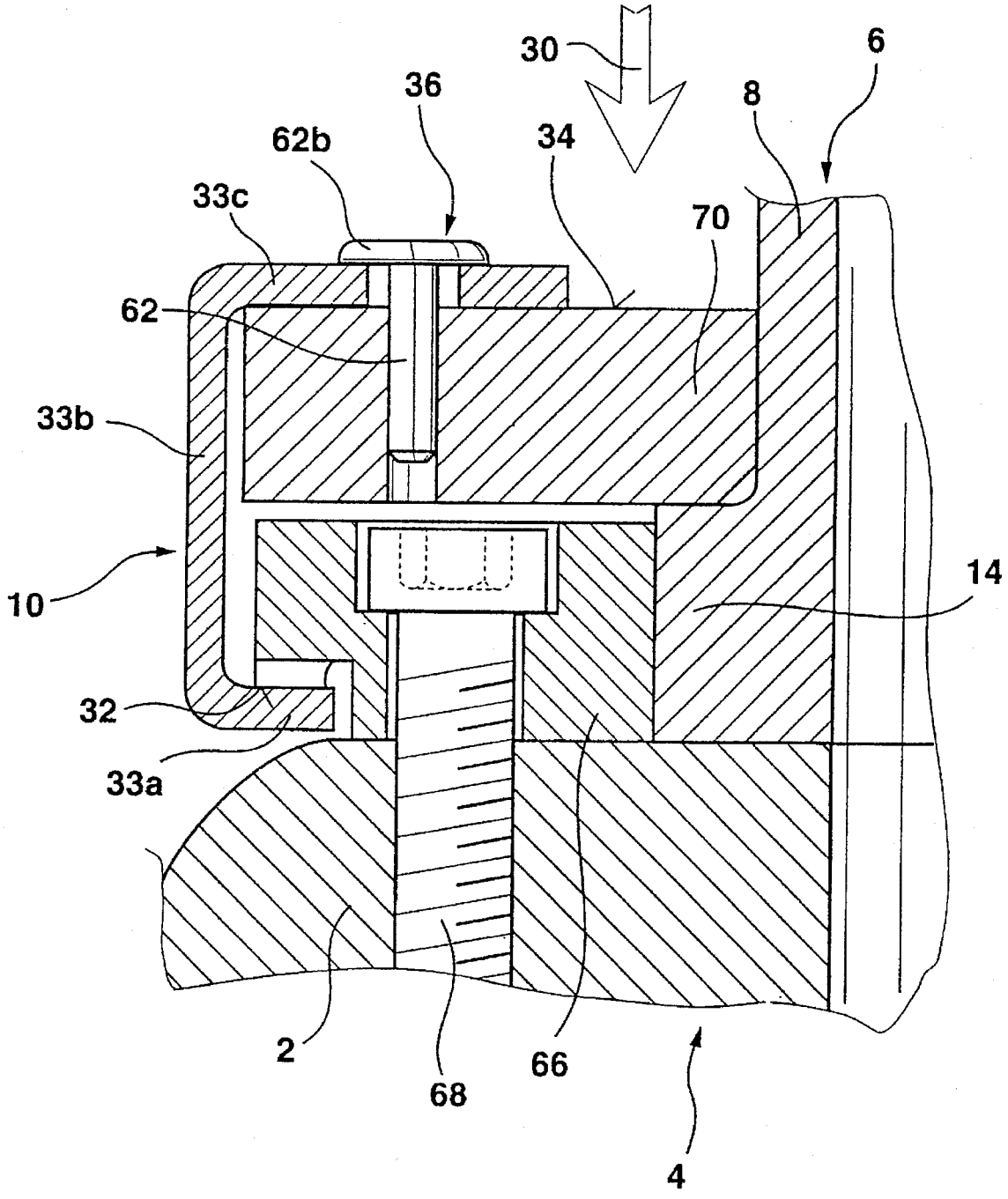

As FIG. 5 shows as an example, a separate counterpart stop piece 70 may be attached to the intake tube 8 of the intake module 6. As an aid in comprehension, the counterpart stop piece 70 will usually be called an intake module stop piece 70 below. The flange 14 of the intake module 6 assures that the intake module stop piece 70 cannot deflect toward the engine 4. To prevent the intake module stop piece 70 from being able to fall off the intake module 6 before the intake module 6 is mounted on the engine 4, the intake module stop piece 70 is glued to the intake tube 8, for instance, or fastened by a fastening ring, not shown. The counterpart retention face 34 or intake module retention face 34 is located in FIG. 5 on the counterpart stop piece 70 or intake module stop piece 70.

Figure 6:
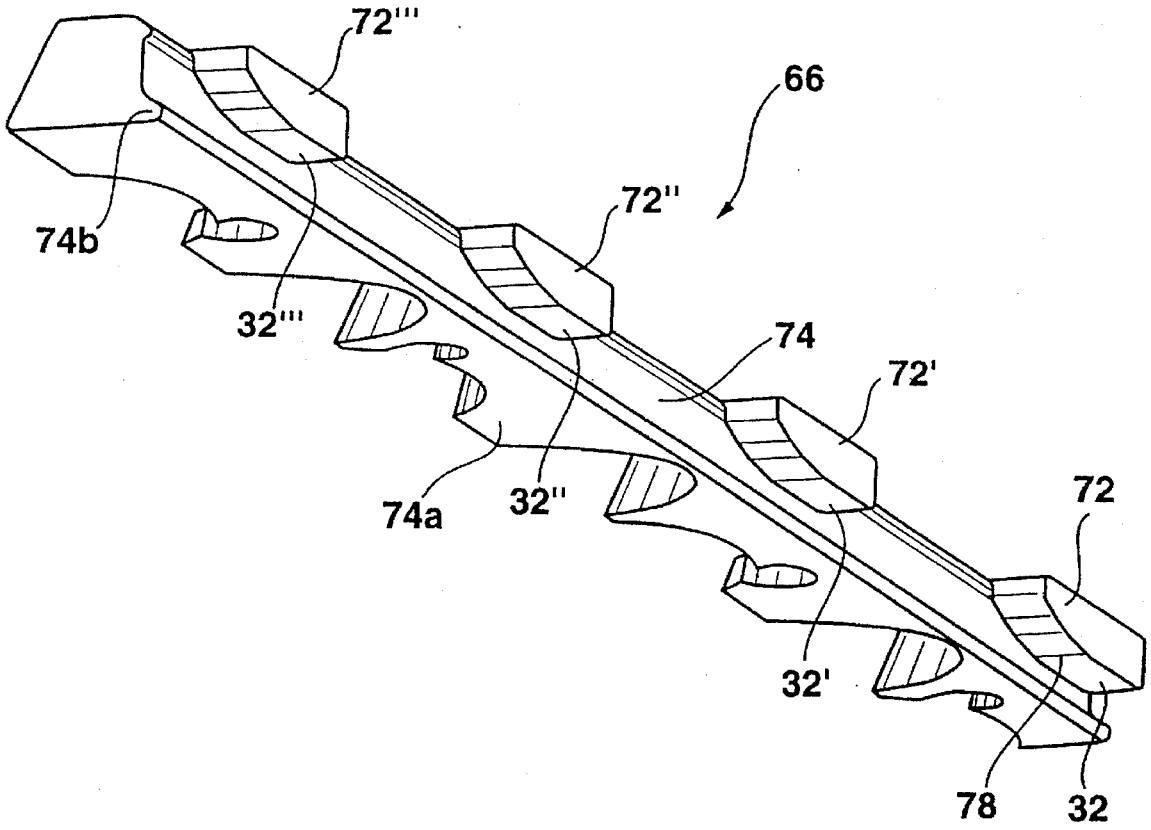

FIG. 6 shows the stop piece 66 or engine stop piece 66 as an individual part in an exemplary, preferred form on a different scale.

As FIG. 6 shows, four cams 72, 72', 72", 72'" are formed onto a longitudinal part 74.of the engine stop piece 66. The longitudinal part 74 has a long side 74*a*, with which the engine stop piece 66 rests on the cylinder head 2 of the engine in the mounted state. In the longitudinal direction of the longitudinal part 74, there is a protrusion 74*b*. The protrusion 74*b* serves to enlarge the long side 74*a*, so that the engine stop piece 66 will be connected to the engine 4 by the greatest possible surface area. The protrusion 74*b* is not present in the exemplary embodiments shown in FIGS. 4 and 5. Another protrusion 78 can also be seen on the cam 72. The significance of the protrusion 78 will be described below in conjunction with FIG. 7*a*.

Figure 7A:
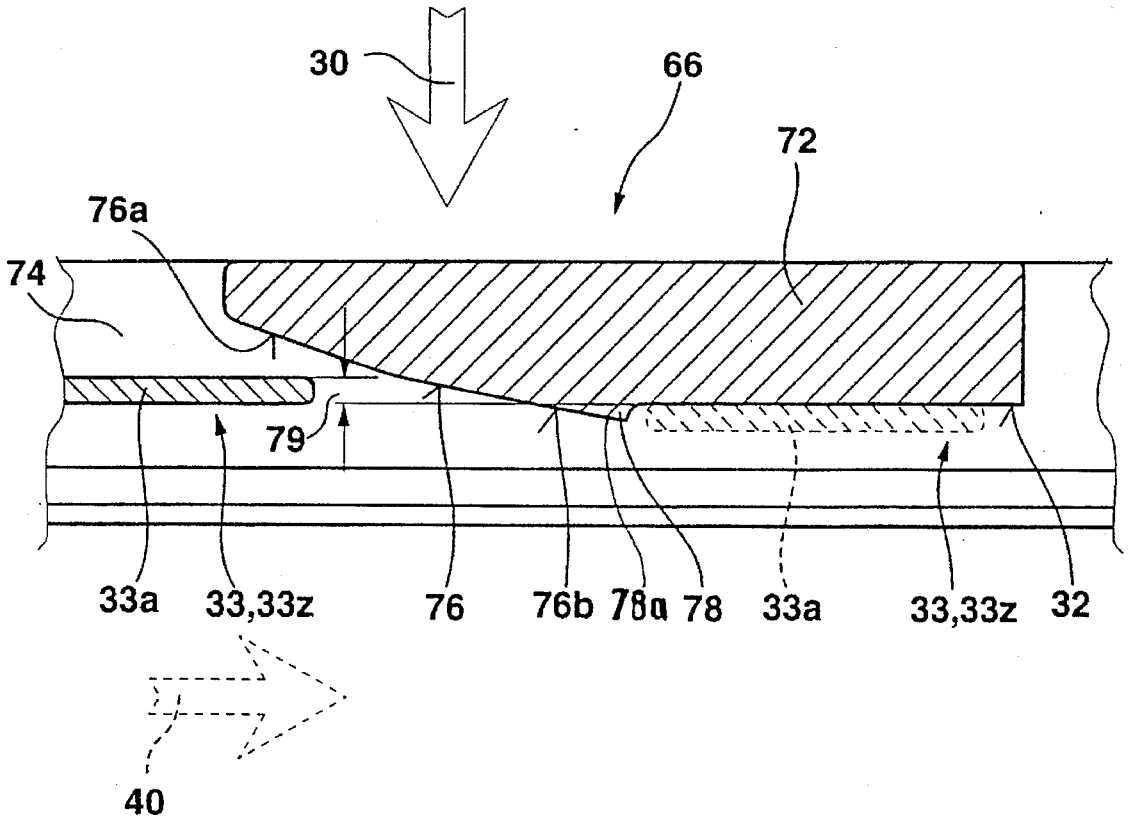

FIG. 7*a* shows a detail of the engine stop piece 66.

For the sake of better comprehension and to show individual contours especially clearly, a sectional plane has been chosen for FIG. 7*a* such that the cam 72 is shown in section. In addition, the sectional plane passes through the leg 33*a* of the retaining element 33 or 33*z*. The section through the leg 33*a* is shown in dashed lines in FIG. 7*a*. Also visible in FIG. 7*a* is an arrow drawn in dashed lines, which symbolizes the closing direction 40 in which the retaining element 33 must be moved in order to establish the solid mechanical connection between the intake module 6 and the engine 4. To undo this connection, the retaining element 33 is moved counter to the closing direction 40.

On the underside (in terms of FIG. 7*a*), of the cam 7 of the engine stop piece 66, is the retention face 32 or engine retention face 32. On the side of the cam 72 from which the leg 33 comes upon motion of the retaining element 33 in the closing direction 40, is a stepped chamfer 76. The chamfer 76 may be subdivided into a chamfer 76*a* and a chamfer 76*b*. The chamfer 76*a* is relatively steep, so that during the assembly process, that is, upon actuation of the retaining element 33 in the closing direction 40, the intake module 6 will be moved quickly toward the engine 4. The second chamfer 76*b* is relatively flat, so that at a desired initial tension or spring force the retaining element 33 will not have to be moved in the closing direction 40 with excessive force.

In FIG. 7*a*, the leg 33*a* of the retaining element 33 is shown in solid lines in the position in which it is located during the assembly. The leg 33*a* of the retaining element 33 is shown again in FIG. 7*a* in dashed lines, in the position in which it is located in the fully mounted state.

A closer look at FIG. 7*a* shows that the leg 33*a*, before touching the chamfer 76, is higher (in terms of FIG. 7*a*) by a clamping path 79 than in the fully mounted state. This means that during the assembly in the retaining element 33 and especially in the bridge 33*b* (FIG. 1), an initial stress or spring force arises from elastic deformation during the assembly, which assures that the intake module 6 is pressed against the engine 4 in the retention direction 30 with initial tension or a spring force.

The protrusion 78 is provided at the transition between the chamfer 76 and the engine retention face 32. The protrusion 78 acts as a securing means 78*a*, which in the fully mounted state assures that the retaining element 33 or 33*z* cannot moved unintentionally counter to the closing direction 40, even if major oscillatory stresses prevail. As a result, it is attained in a simple way that the intake module 6 remains firmly and durably joined to the engine 4, without complicated and expensive securing provisions.

As FIG. 7*a* shows, the engine retention face 32 is located on the cam 72. In the exemplary embodiments shown in FIGS. 4 and 5, the cam 72 is associated indirectly, via the engine stop piece 66, with the cylinder head 2 of the engine 4. In FIGS. 1 and 2, it is equally possible to dispense with the engine stop piece 66 and to provide the cam 72 with the engine retention face 32 directly on the cylinder head 2 or on the engine 4.

In the exemplary embodiment shown, the chamfer 76 is located adjoining the engine retention face 32 that is joined to the engine 4 and is essentially oriented in the direction of the retention direction 30. It should be pointed out that the invention can be modified such that the chamfer 76 can be provided not in the region of the engine retention face 32 but rather adjoining the intake module retention face 34 that is joined to the intake module 6 and is oriented substantially counter to the retention direction 30. This transposition of the chamfer 76 from the face associated with the engine 4 to the face associated with the intake module 6 can be done by one skilled in the art, without requiring additional illustration in the drawing.

Figure 7B:
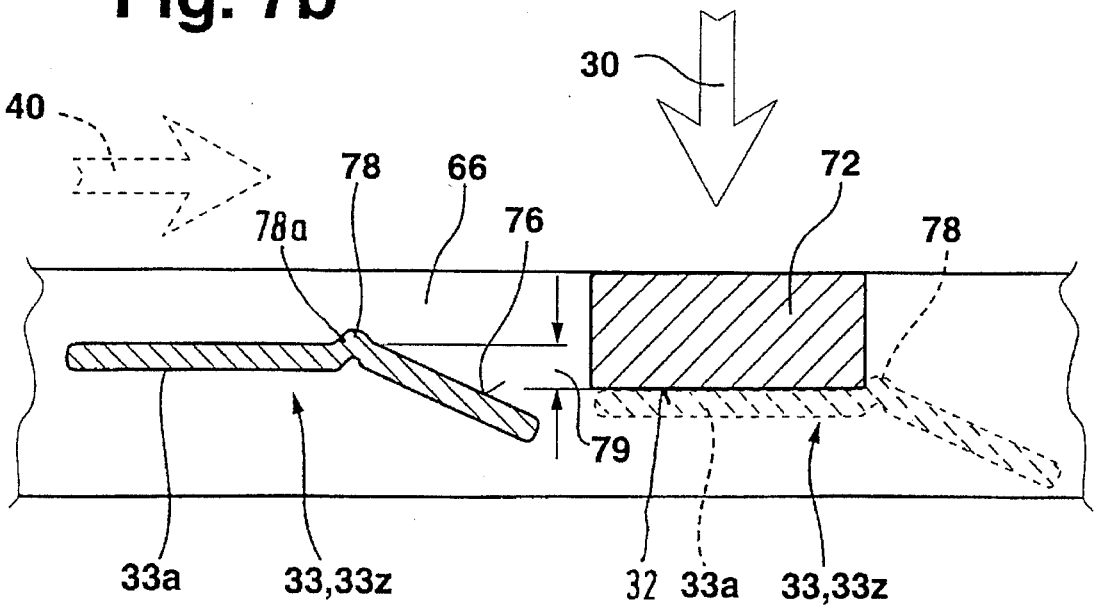

FIG. 7*b* shows a further, preferably selected, especially advantageous exemplary embodiment.

The sectional plane in FIG. 7*b* is the same as in FIG. 7*a*.

Unlike the exemplary embodiment shown in FIG. 7*a*, here the chamfer 76 is not located on the cam 72; instead, the chamfer 76 is formed onto the lower leg 33*a* of the retaining element 33. The retaining element 33 or 33*z* is for instance a part stamped out of sturdy sheet metal. In that case, it is very simple, without significant additional expense to stamp out the retaining element 33 or 33*z* in such a way that the chamfer 76 is created along with the leg 33*a*.

In FIG. 7*b*, the same leg 33*a* is shown twice. In the fully mounted state, the leg 33*a* of the retaining element 33 is in the position shown in dashed lines in FIG. 7*b*. Solid lines represent the leg 33*a* of the retaining element 33 in the position in which it is located during mounting, shortly before the chamfer 76 reaches the cam 72. If the retaining element 33 is displaced farther in the closing direction 40, as far as the position shown in dashed lines, then the lower leg 33*a* of the retaining element 33 is pulled downward (in terms of FIG. 7*b*) in the retention direction 30 by the length of the clamping path 79 by means of the cam 72, which slides along the chamfer 76; the result is an initial tension or spring force in the retaining element 33 or 33*z*, as a result of which the intake module 6 is braced with initial tension or spring force in the retention direction 30 against the engine 4. In the position shown in dashed lines, the protrusion 78 provided on the leg 33*a* of the retaining element 33 at the end of the chamfer 76 assures that the retaining element 33 will not be displaced counter to the closing direction 40 even under the influence of major shaking stress. In this position, the retaining element 33 interlocks with the cam 72, because of the protrusion 78. This creates the securing means 78*a*. The securing means 78*a* assures that unintentional loosening of the intake module 6 from the engine 4 cannot occur under any circumstances whatever.

Figure 8:
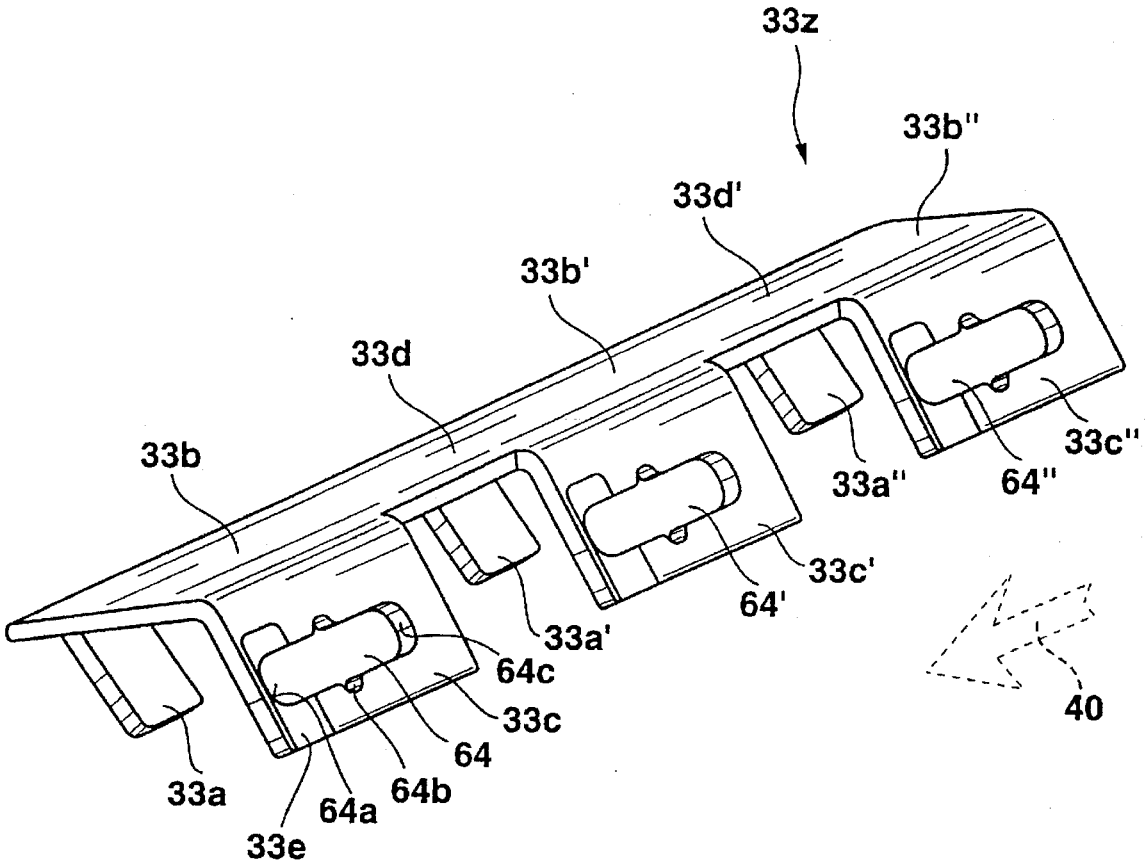

FIG. 8 shows as an example an especially advantageous embodiment of the cohesive retaining element 33*z*.

As FIG. 8 shows, the fastening slit 64 has an elongated shape, with a first end 64*a* and a second end 64*c*. The fastening slit 64 has a widened portion 64*b* between the two ends 64*a*, 64*c*.

In a preferred embodiment (FIG. 4), the retaining element 33 as held by the head 62*b* of the pin 62 on the flange 14 of the intake module 6. Except for the widened portion 64*b* (FIG. 8), the fastening slit 64 is of a width such that the head 62*b* of the pin 62 does not fit through the fastening slit 64.

Before the intake module 6 is joined to the engine 4, the position of the retaining element 33*z* is such that the pin 62 (FIG. 4) is located in the region of the first end 64*a* (FIG. 8). A bulge 33*e* is provided on the leg 33*c* in the region of the first end 64*a*. The bulge 33*a* is either a thickening of the width of material of the leg 33*c*, or else the leg 33*c* is bent in undulating fashion to form the bulge 33*e*. The purpose of the bulge 33*e* is that before mounting of the intake module 6 on the engine 4, the retaining element 33 is easily clamped in place between the head 62*b* (FIG. 4) and the flange 14 and as a result stays in its intended position. This makes it easier to mount the intake module 6 on the engine 4. If needed, the bulge 33*e* may optionally be omitted.

During the mounting of the intake module 6 on the engine 4, the retaining element 33*z* is displaced in the closing direction 40 (FIG. 8), for instance with simple blows of a hammer, until the retaining element 33*z* with the leg 33*a* reaches the position shown in dashed lines in FIG. 7. The hammer blows are merely an example. In modern production facilities, it is more likely that a closing device will be used instead, in which the retaining element 33 or 33*z* is displaced in the closing direction 40 with the aid of a hydraulic cylinder or a pneumatic cylinder. The second end 64*c* of the fastening slit 64 is located just in front of the pin 62 in the position shown in dashed lines (FIG. 7*a*). The same is accordingly true upon shaping of the retaining element 33 or 33*z* of FIG. 7*b*.

The widened portion 64b (FIG. 8) is provided to allow the retaining element 33*z* to be slipped over the head 62*b* of the pin 62 (FIG. 4). As a result, it is possible first to attach the pin 62 and then the retaining element 33*z* to the intake module 6. The pin 62 can for example be integrated with the intake tube 8 by means of a joint injection process. Optionally, the widened portion 64*b* may be dispensed with, if when the pin 62 is attached to the flange 14 the retaining element 33 or 33*z* is attached simultaneously. In that case, it is no longer possible to remove the retaining element 33 or 33*z* easily.

The cohesive retaining element 33*z* differs from the retaining element 33 essentially only in that the retaining element 33 has only one lower leg 33*a* and one upper leg 33*c*, while in the cohesive retaining element 33*z* there are a plurality of lower legs and/or upper legs. In the cohesive retaining element 33*z*, the number of lower legs present may differ from the number of upper legs. It is also possible to embody the retaining element 33 or 33*z* such that on at least one of the legs, bracing between the leg and the engine retention face 32 or intake module retention face 34 takes place at multiple 9*a*.

Figure 9A:
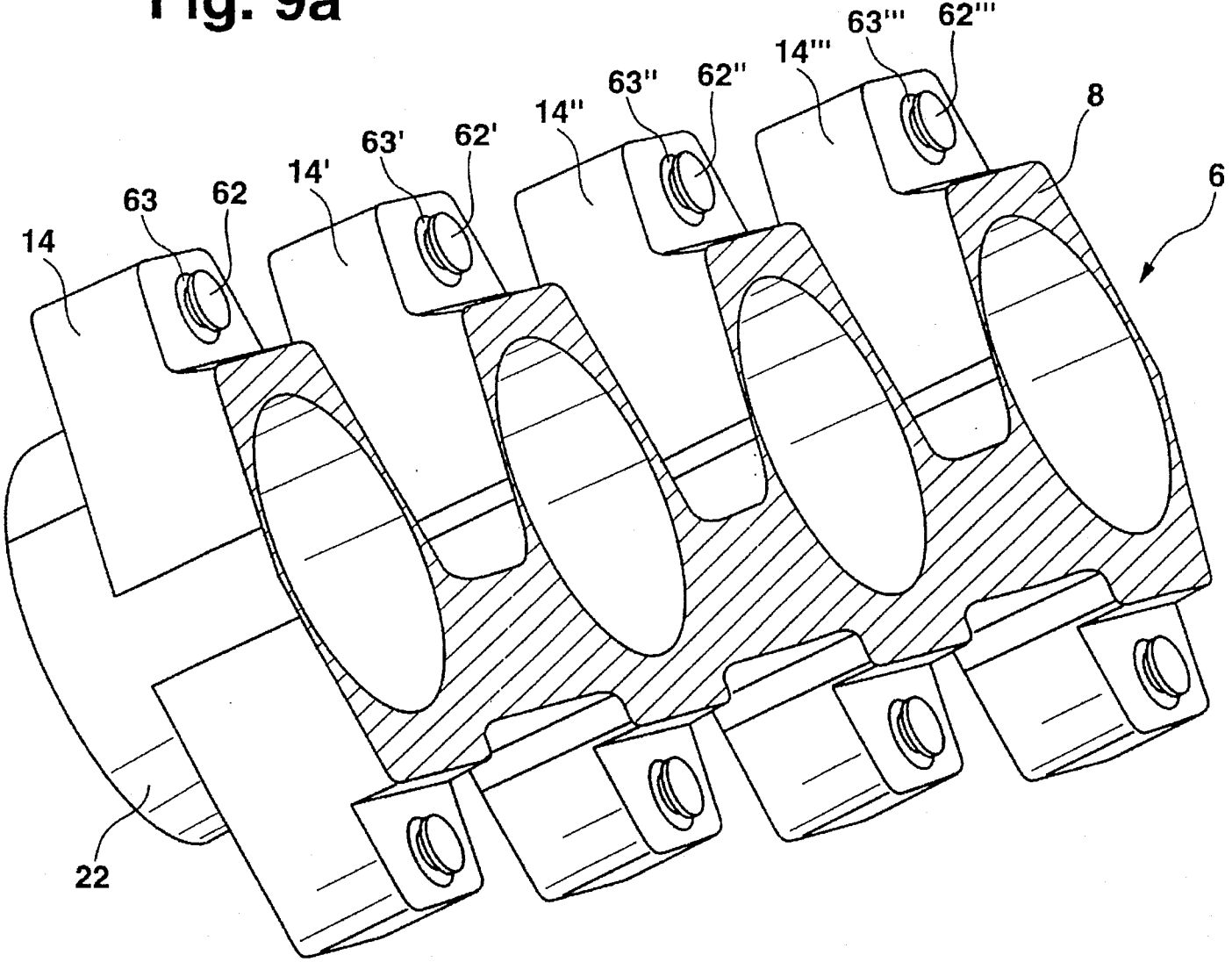

FIG. 9*a* shows an exemplary selected advantageous option for embodying the region of the intake tube 8 of the intake module 6, which plays a role in fastening the intake module 6 to the engine 4. The remainder of the suction tube 8 has been omitted in FIG. 9*a*, for the sake of clarity. The protrusion 22 can be seen in FIG. 9*a*.

Figure 9B:
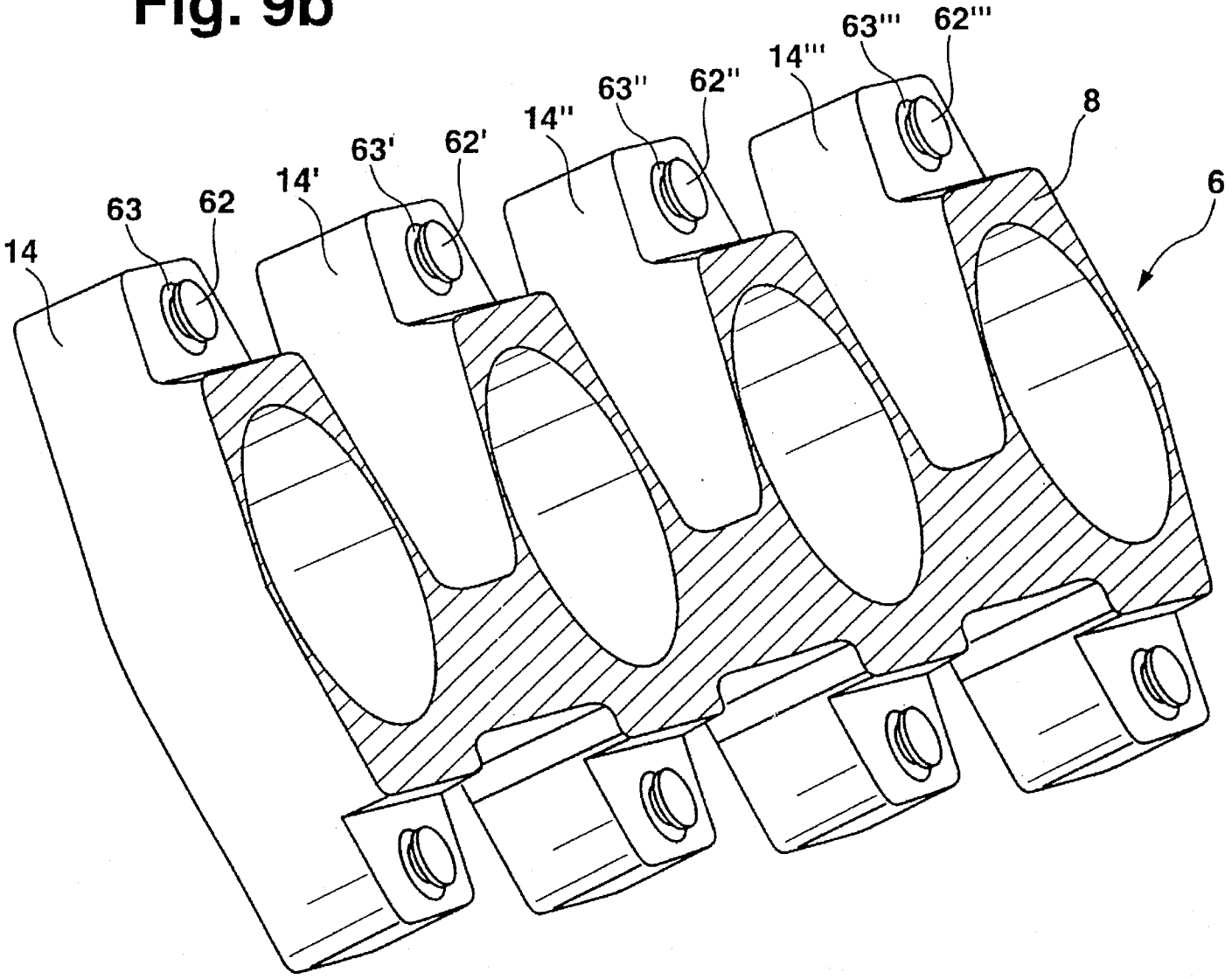

FIG. 9*b* shows a version without this protrusion. FIG. 9*b* shows an exemplary embodiment in which the side of the intake module 6 toward the engine 4 is smooth and rests on a smooth face of the engine 4.

It can be seen in FIGS. 9*a* and 9*b* that in addition to the flange 14, there are additional flanges 14', 14", 14'" on the intake tube 8. The flanges 14', 14", 14'" are embodied in the same way as the flange 14. As FIG. 4 shows, the retaining element 33 is held in the region of the fastening slit 64 by the pin 62. In the same way, the retaining element 33 or 33*z* is held by the pin 62' (FIGS. 9*a*, 9*b*) in the region of the fastening slit 64' (FIG. 8). The same is correspondingly true for the further fastening slit 64".

During mounting of the intake module 6 to the engine 4, the retaining element 33 or 33*z* is located on the intake module in the position in which the leg 33*a* (FIG. 8) of the retaining element 33*z* passes through, between the cam 72 and the cam 72' (FIG. 6). In the same way, the leg 33*a'*, during mounting of the intake module 6 on the engine 4, is passed through the interstice between the cam 72' and the cam 72". Correspondingly, the leg 33*a"*0 is passed between the two cams 72" and 72'".

To firmly fasten the intake module 6 on the engine 4, the retaining element 33 is moved in the closing direction 40 (FIGS. 7*a* and 7*b*), for instance with the aforementioned closing device, so that the leg 33*a* moves from the position shown in solid lines in FIGS. 7*a* and 7*b* to the position shown in dashed lines in FIGS. 7*a* and 7*b*. The situation is the same with the leg 33*a'*, which once assembly has been completed is braced against the engine retention face 32'.

Figure 10:
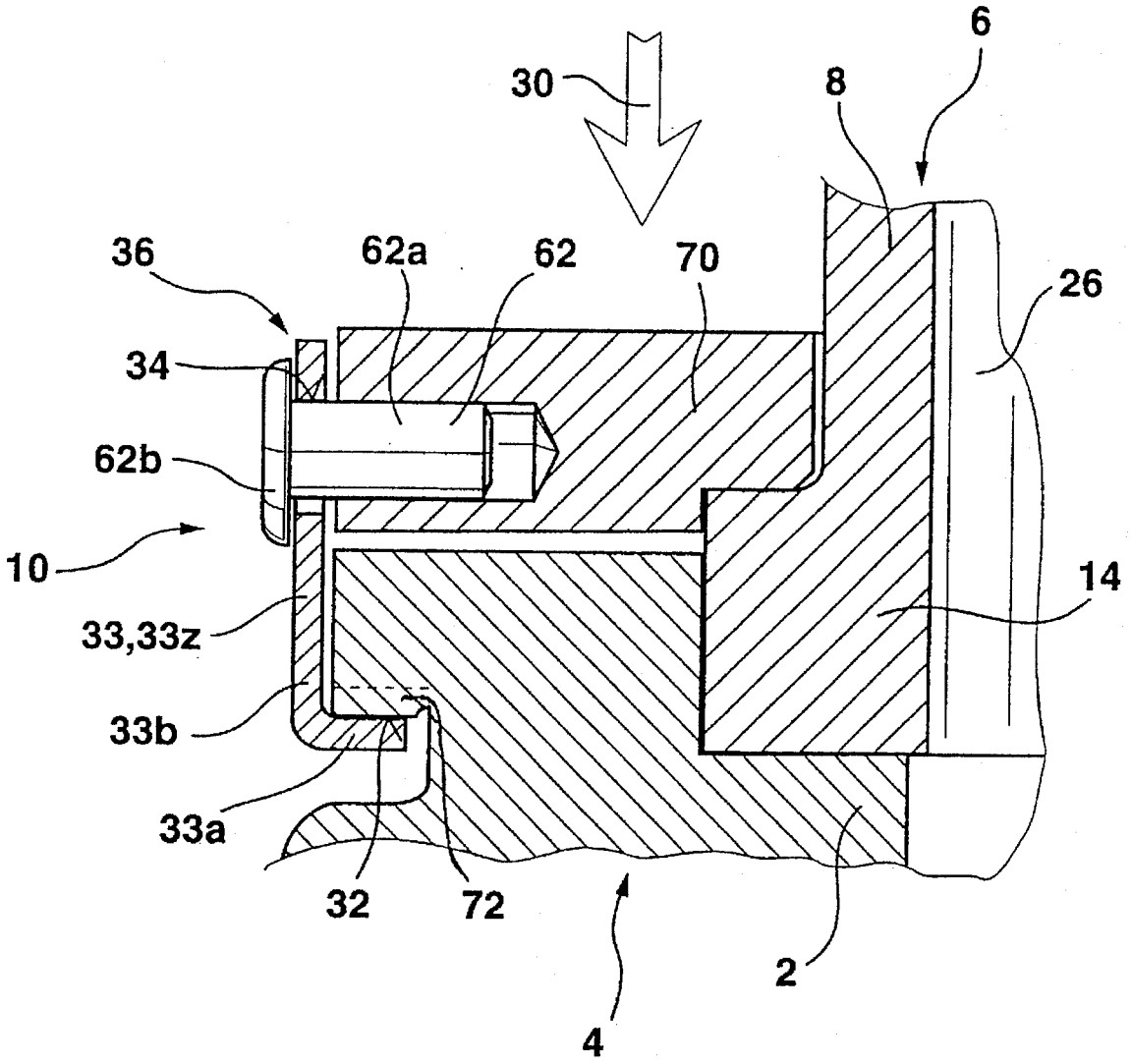
Figure 11:
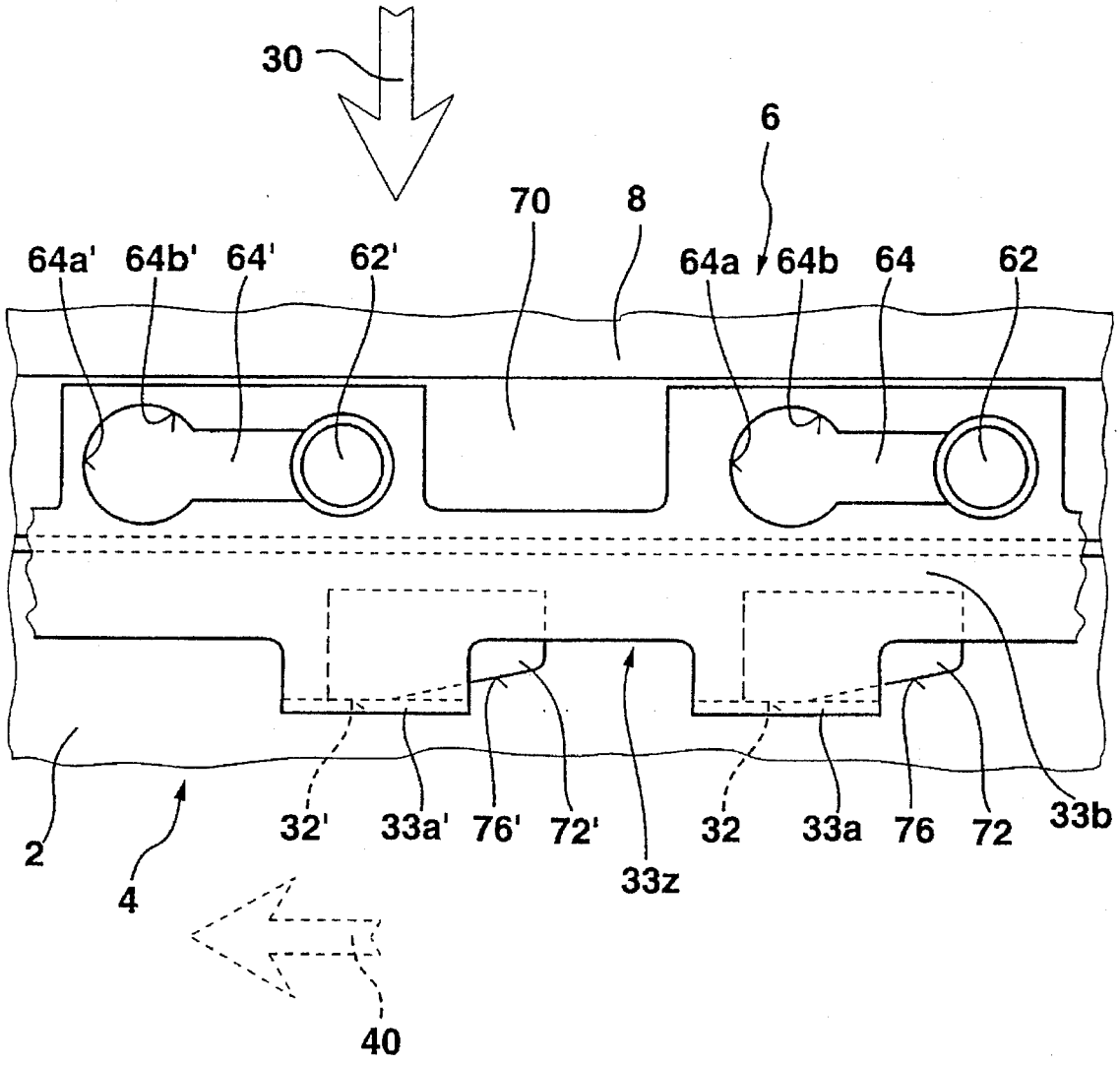

FIGS. 10 and 11 show examples of details of a further preferred, selected, especially advantageous embodiment of the invention, in cross section (FIG. 10) and in a side view (FIG. 11).

Parts not shown in FIGS. 10 and 11 are largely equivalent to those of the exemplary embodiment shown in FIGS. 1 and 3.

As FIG. 10 shows, the retaining element 33 or 33*z* has a region of approximately L-shaped cross section.

The arrangement of the engine retention face 32 is equivalent to that of the arrangement in FIG. 1, but it can also, as shown in FIG. 4, be done via the engine stop piece 66.

In the exemplary embodiment shown in FIG. 10, the intake module retention face 34 is located in the upper circumferential region (in terms of FIG. 10) of the shaft 62*a* of the pin 62. As in the other exemplary embodiment, the retaining element 33 or 33*z* is braced against the intake module retention face 34 in the exemplary embodiment of FIG. 10. The retaining element 33 or 33*z*, via the bracing against the intake module retention face 34, holds the intake module 6 in the retention direction 30 against the cylinder head 2 of the engine 4.

FIGS. 10 and 11 show the engine 4 and intake module 6 in the fully assembled state. To separate the intake module 6 from the cylinder head 2, the retaining element must be actuated to the right (in terms of FIG. 11) counter to the closing direction 40, for instance with the closing device. This moves the first end 64*a* of the fastening slit 64 into the region of the pin 62. In this position of the retaining element 33*z*, the leg 33*a'* of the retaining element 33*z* is located between the two cams 72 and 72'. In this position, the intake module 6 can be raised from the cylinder head 2 counter to the retention direction 30. To re-install the intake module 6, the retaining element 33*z* must be in the last-described position. To fasten the intake module 6 to the engine 4, the intake module 6 is placed on the engine 4 and then the retaining element 33*z* is pushed in the closing direction 40. This moves the leg 33*a* of the retaining element 33*z* first into the region of the chamfer 76 of the cam 72. Further displacement of the retaining element 33*z* in the closing direction 40 moves the leg 33*a* into the region of the engine retention face 32 joined to the engine 4. The retaining element 33 or 33*z* is dimensioned such that in this position, the intake module 6 is held with initial tension or spring force in the retention direction 30.

In the exemplary embodiment shown in FIGS. 10 and 11, the pins 62, 62', on which the intake module retention face 34 is located, are joined to the intake module 6 via the intake module stop piece 70. It is possible to dispense with the intake module stop piece 70 and to provide the pins 62, 62' directly on the intake module 6.

In a further modification of the exemplary embodiment shown in FIGS. 10 and 11, it is possible to join the pins 62, 62' not to the intake module 6 but rather to the engine 4. In that case, the intake module retention face 34 is not located on the pins 62, 62'; instead, the side of the pins oriented in the retention direction 30 acts as the engine retention face 32, and the intake module retention face may be joined to the intake module 6, as shown in FIG. 2, for example.

Figure 12:
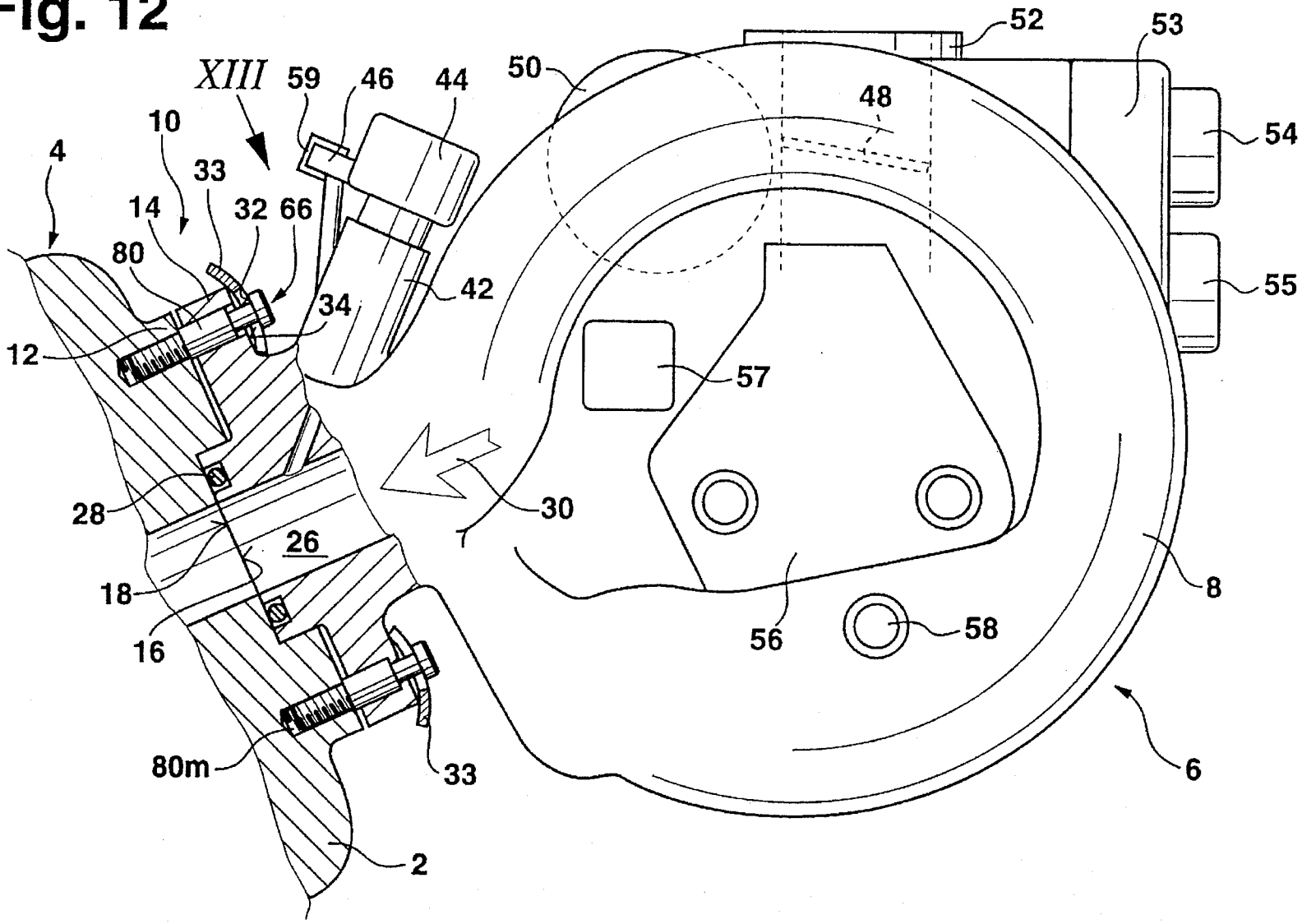

FIG. 12 shows another preferred, selected, highly advantageous exemplary embodiment.

As in FIG. 1, in FIG. 12 as well, only a portion of the cylinder head 2 is shown, and a portion of the intake module 6 is shown in section.

In the engine 4 or cylinder head 2, a nut thread 80*m* is provided. A bolt 80 or stay bolt is screwed into the nut thread 80*m*. The bolt 80 is connected to the engine 4. The bolt 80 in this exemplary embodiment acts as a stop piece 66, also called the engine stop piece 66, by way of which the engine retention face 32 is joined to the engine 4. As the exemplary embodiment shows, the bolt 80 is releasably screwed into the cylinder head 2. The bolt 80 may also be joined to the engine 4 in some other way, including in a nonreleasable fashion. Dismantling of the intake module 6 from the engine 4 does not require loosening of the bolt 80 from the cylinder head 2.

The bolt 80 may additionally serve the purpose of centering the intake module 6 or intake tube 8 relative to the engine 4.

Figure 13:
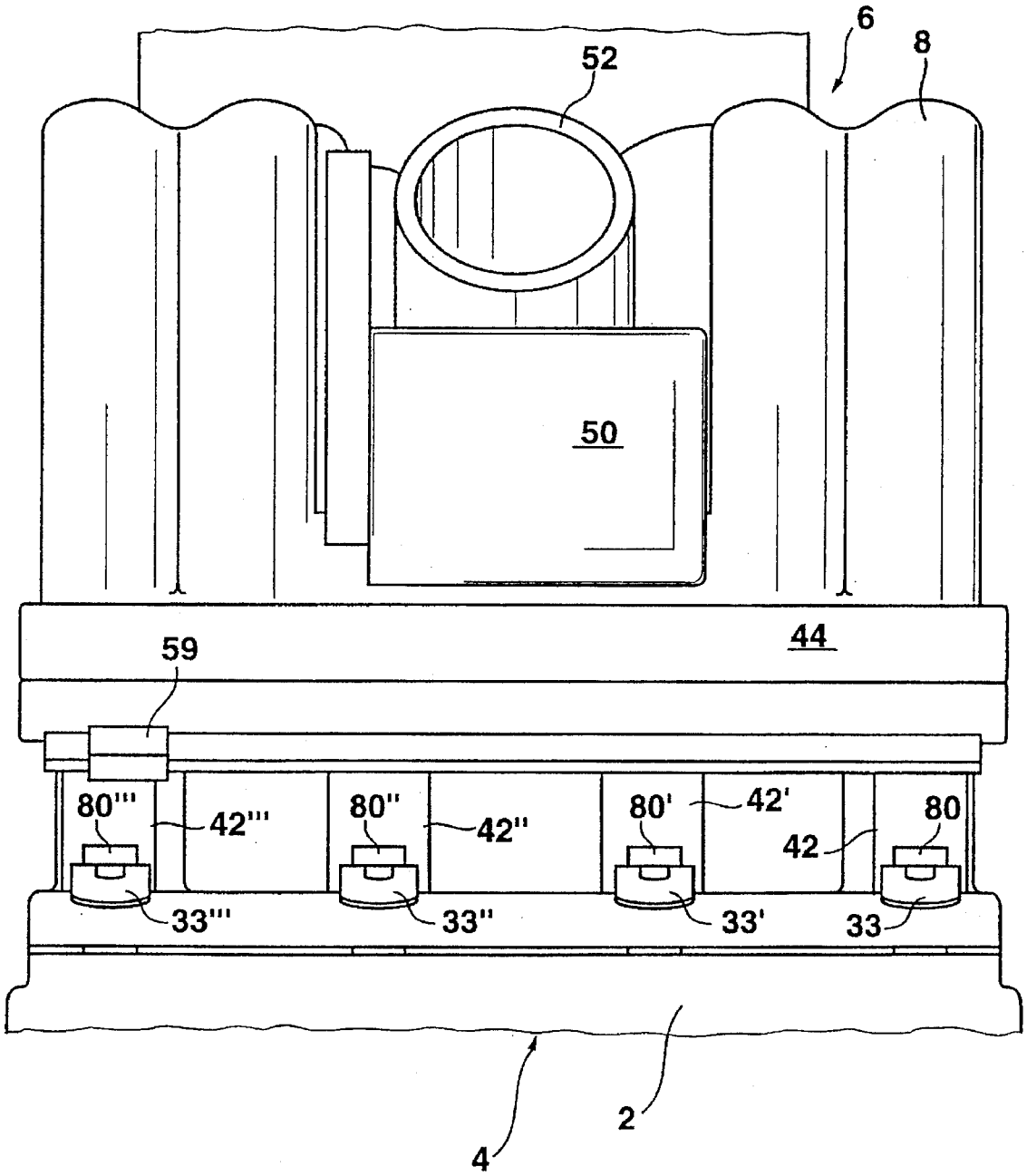

FIG. 13 shows a view in the direction of the arrow XIII of FIG. 12.

As FIGS. 12 and 13 show, a plurality of bolts 80, 80', 80", 80'" are provided. There is one retaining element 33, 33', 33", 33'" on each bolt 80, 80', 80", 80'", between the engine retention face 32 (FIG. 12) provided on the bolt 80 and intake module retention face 34 provided on the flange 14.

Figure 14:
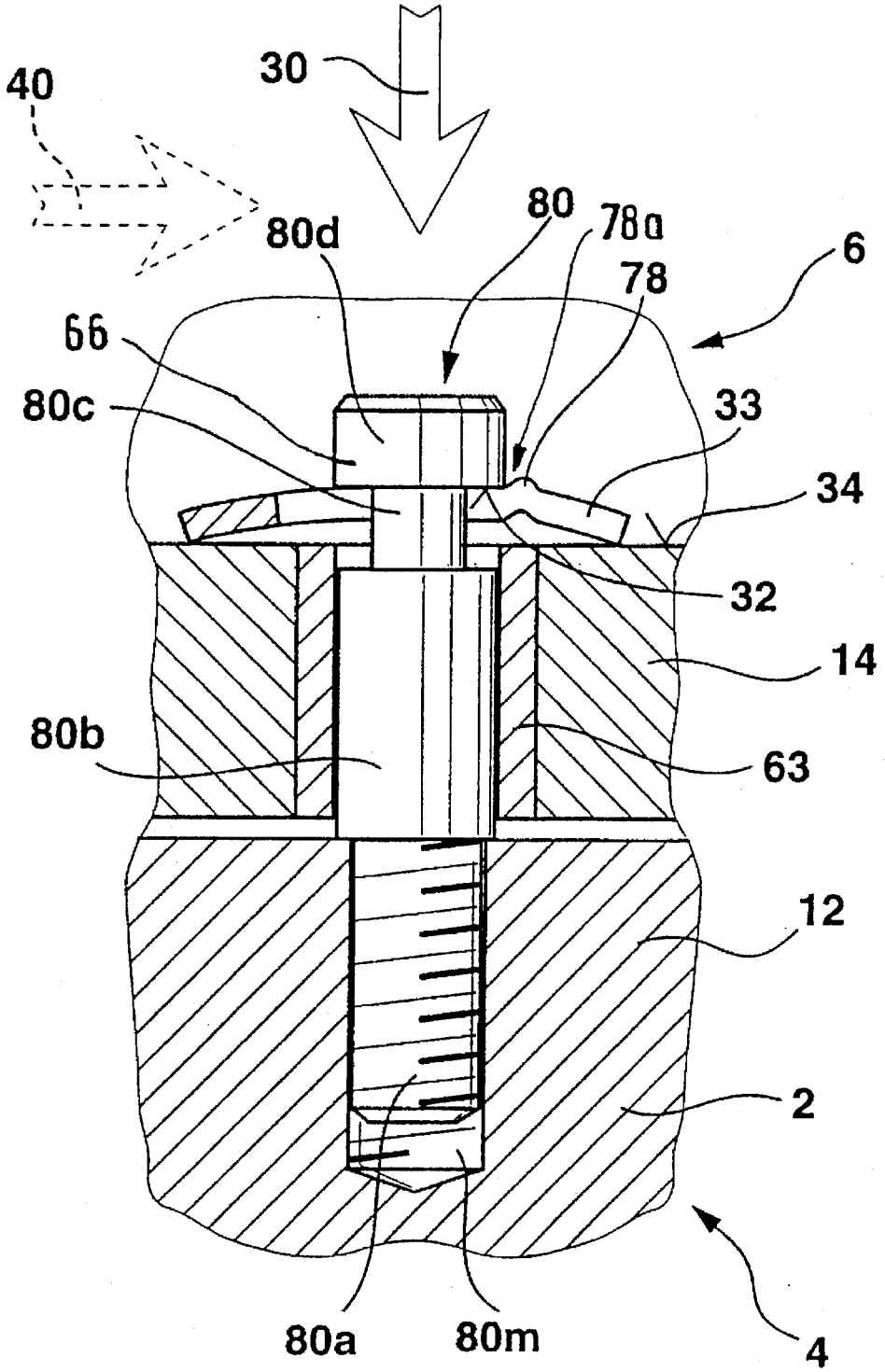

FIG. 14 shows a detail of FIG. 12 on a different scale, as an example.

As FIG. 14 shows, the bolt 80 can be said to have various regions; that is, the bolt 80 substantially comprises a screw thread 80*a*, a shank 80*b*, a turned groove 80*c*, and a bolt head 80*d*.

At the transition from the turned groove 80*c* to the bolt head 80*d*, an end face is formed, pointing toward the cylinder head 2 or in other words in the direction of the retention direction 30, and the engine retention face 32 is located on this end face. On the top side (in terms of FIG. 14) of the flange 14, that is, pointing counter to the retention direction 30, is the intake module retention face 34, also called the counterpart retention face 34. The retaining element 33 (FIG. 14) is braced on one end against the engine retention face 32 and on the other against the intake module retention face 34. The retaining element 33 has a curved shape, which is pressed elastically somewhat flat in the installed state, so that the intake module 6 is held in the retention direction 30 with elastic initial tension or spring force against the engine 4.

FIG. 14 shows the retaining element 33 in the fully mounted state. Beginning with this position as shown, the retaining element 33 can be displaced counter to the closing direction 40 toward the left (in terms of FIG. 14). This overcomes the initial tension, and the intake module 6 can be lifted from the cylinder head 2 of the engine 4.

By displacing the retaining element 33 in the closing direction 40, the retaining element 33 is clamped between the engine retention face 32 and the intake module retention face 34 and brought to the position shown in FIG. 14.

To prevent the retaining element 33 from slipping unintentionally away counter to the closing direction 40 even when severely stressed by shaking, the protrusion 78 is also provided on the retaining element 33. FIG. 14 shows the retaining element 33 with the protrusion 78. FIG. 12 shows the retaining element 33 without the protrusion. The protrusion 78 shown in FIG. 14 and the figures that follow is part of the securing means 78*a* and has the same function that has already been described in conjunction with FIGS. 7*a* and 7*b*.

Figure 15:
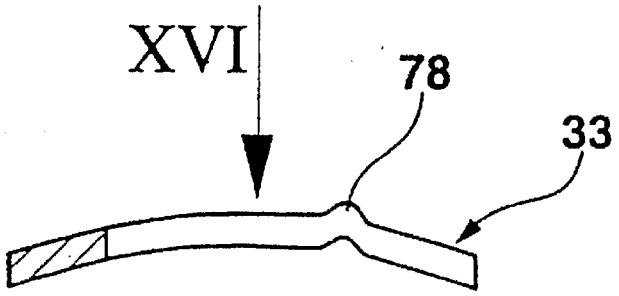
Figure 16:
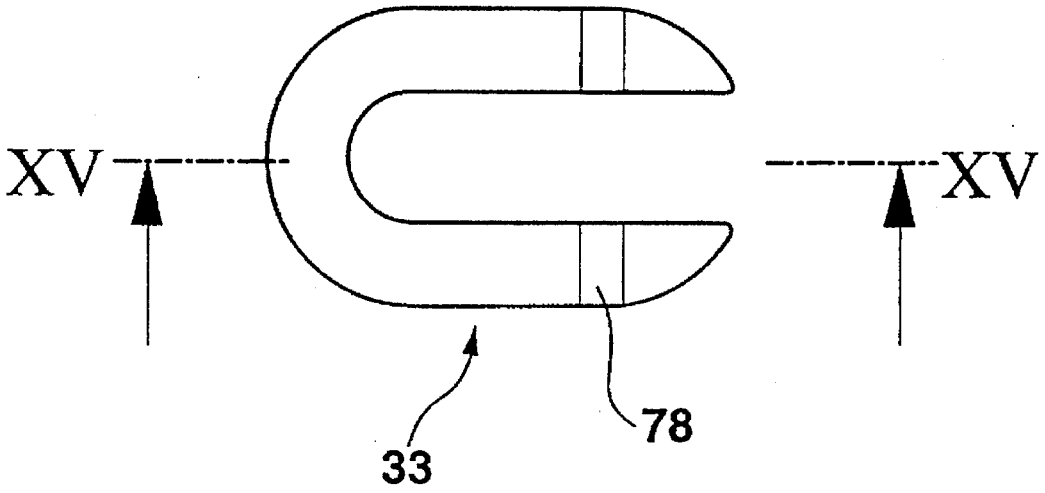

In FIGS. 15 and 16, the retaining element 33 is shown separately. FIG. 16 is a view in the direction of the arrow XVI of FIG. 15. FIG. 15 shows a cross section taken along the sectional line XV of FIG. 16.

In FIG. 15, one can see that the retaining element 33 is curved. The total thickness of the retaining element 33 including the curvature is greater than the distance between the engine retention face 32 and the intake module retention face 34, so that in a mounted state in the retaining element 33 an elastic initial tension or spring force arises, and the intake module 6 is pressed against the engine 4 in the retention direction 30 with an initial tension or spring force.

If the invention is embodied in the way shown as an example in FIG. 13, then for mounting and dismantling the retaining elements 33, 33', 33", 33'", each of the retaining elements 33, 33', 33", 33'" is brought separately to the appropriate position. However, it is also possible for a plurality of retaining elements 33 to be combined into one cohesive retaining element 33*z*, as the exemplary embodiment described below shows.

Figure 17:
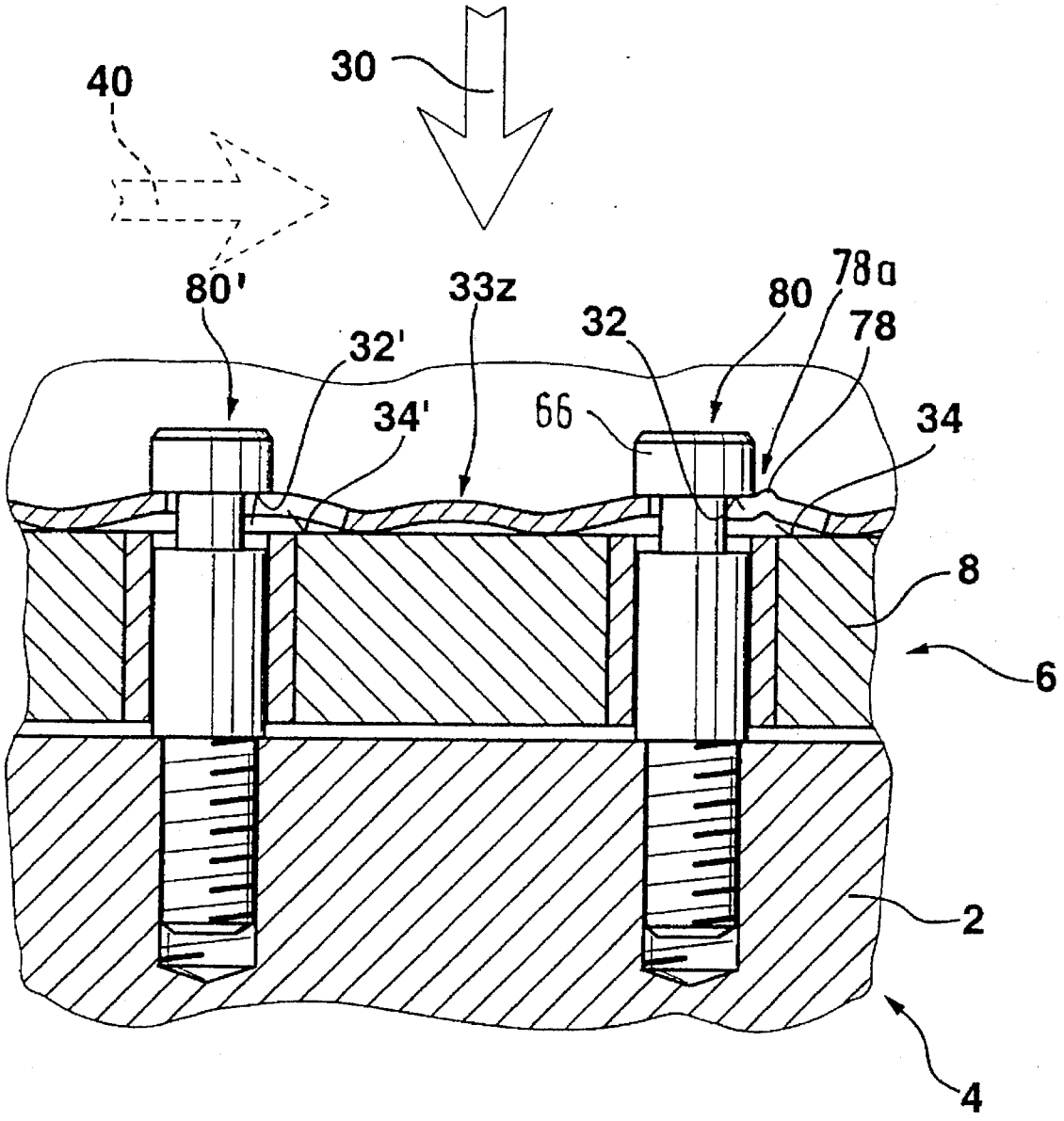

FIG. 17 shows a further selected, especially advantageous exemplary embodiment.

In FIG. 17, the retaining element 33*z* is embodied such that in the mounted state, the retaining element 33*z* is braced against a plurality of engine retention faces 32, 32' and a plurality of intake module retention faces 34, 34'.

Optionally, the protrusion 78 may be provided at one or more points on the retaining element 33, being attached or provided in such a way that the securing means 78*a* is created, and that in the mounted state the retaining element 33*z* will not shift unintentionally counter to the closing direction 40.

The retaining element 33*z* may be embodied such that a single retaining element 33*z* is braced against two bolts 80, 80' or more than two bolts. Alternatively, the retaining element 33*z* may be embodied such that the retaining element 33*z* is braced against all the bolts that are present.

Figure 18:
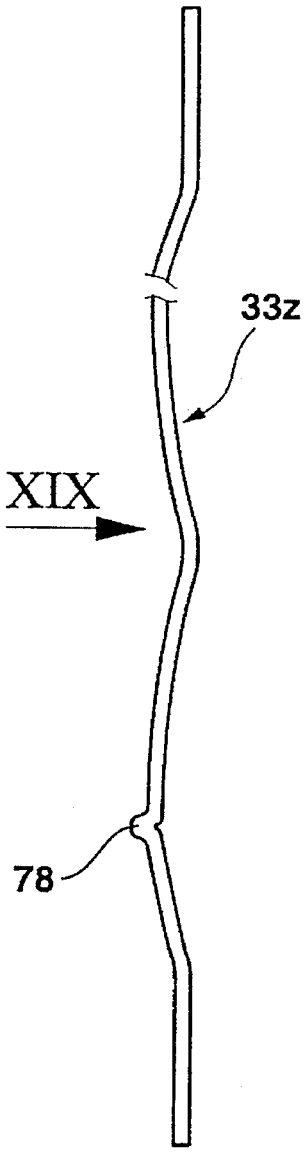
Figure 19:
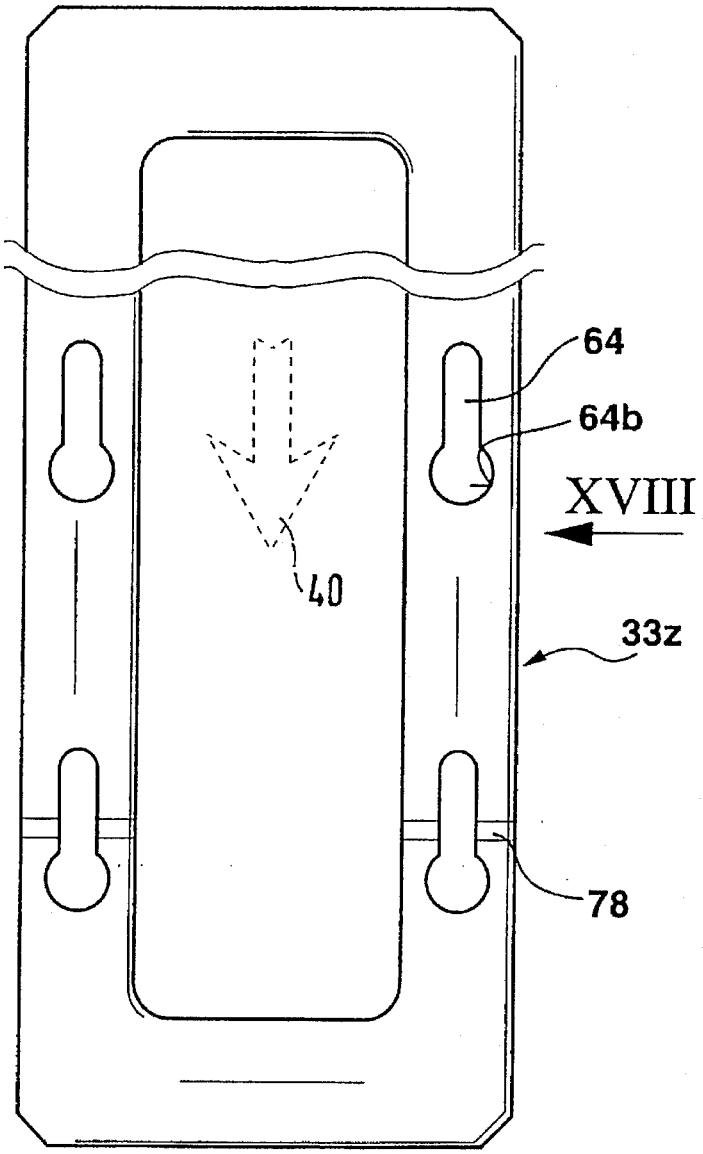

FIGS. 18 and 19 show in exemplary form the retaining element 33*z*, which by way of example is embodied such that the bracing can be effected via four bolts on the engine 4. FIG. 18 shows the retaining element 33*z* in a side view, and FIG. 19 shows the retaining element 33*z* in a plan view.

Figure 20:
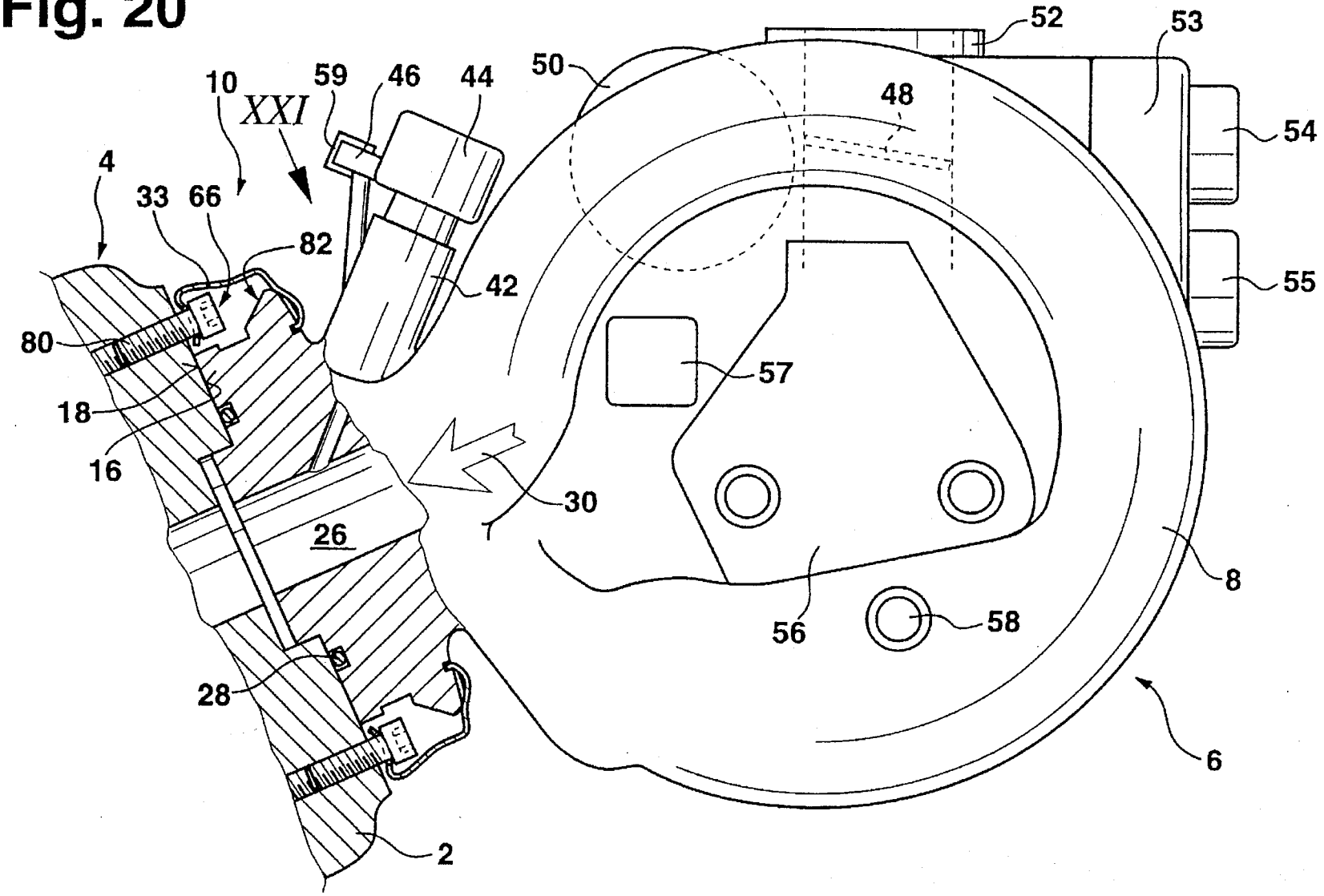

FIG. 20 shows another especially selected, advantageous exemplary embodiment.

FIG. 20 shows an end-on view of the intake module 6 with the intake tube 8, as well as a portion of the cylinder head 2 of the engine 4. The region around the fastening means 10 is shown in section. The section line is marked XX in FIG. 21.

Figure 21:
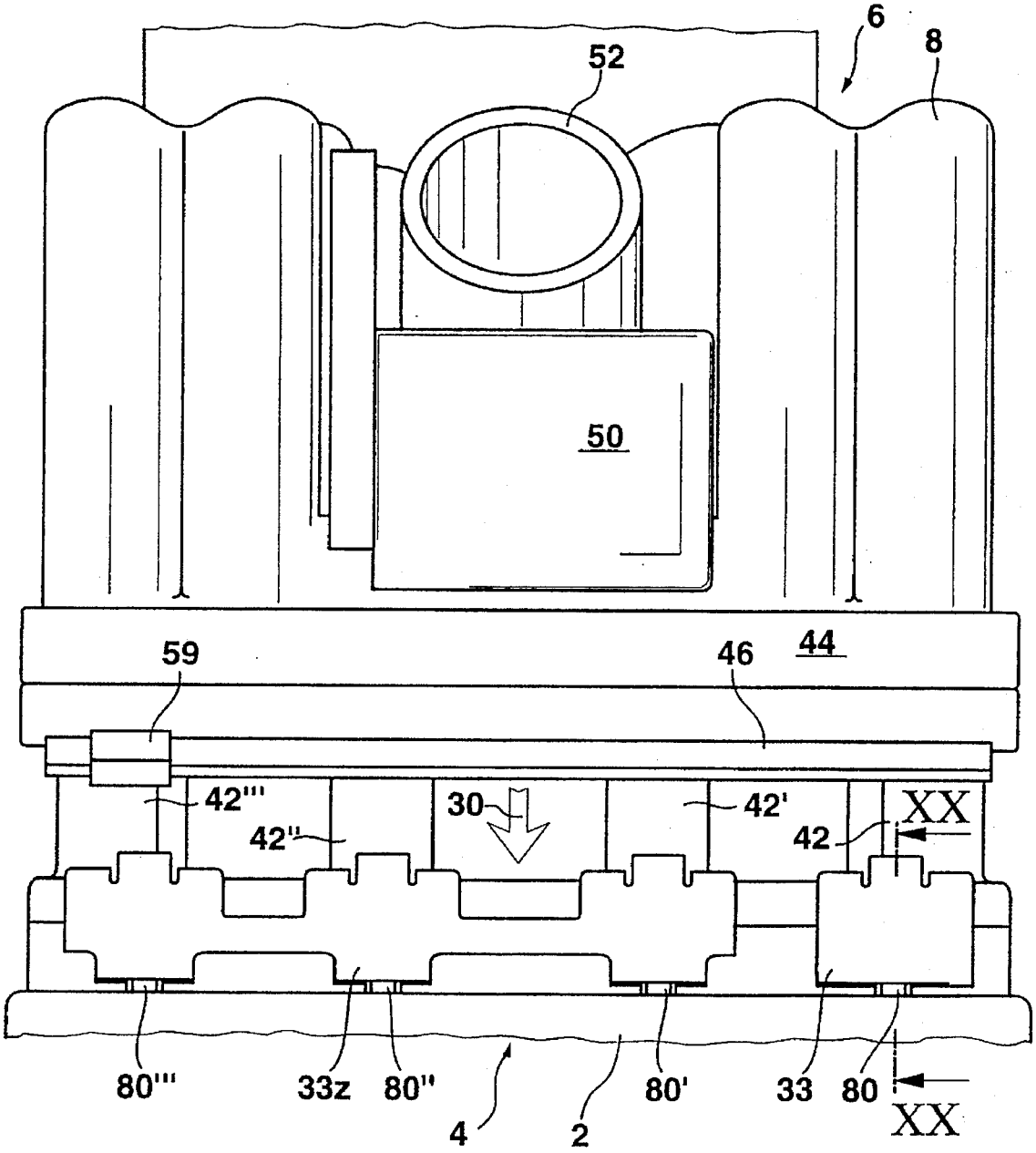

FIG. 21 shows a side view in the direction of the arrow XXI shown in FIG. 20.

Figure 22:
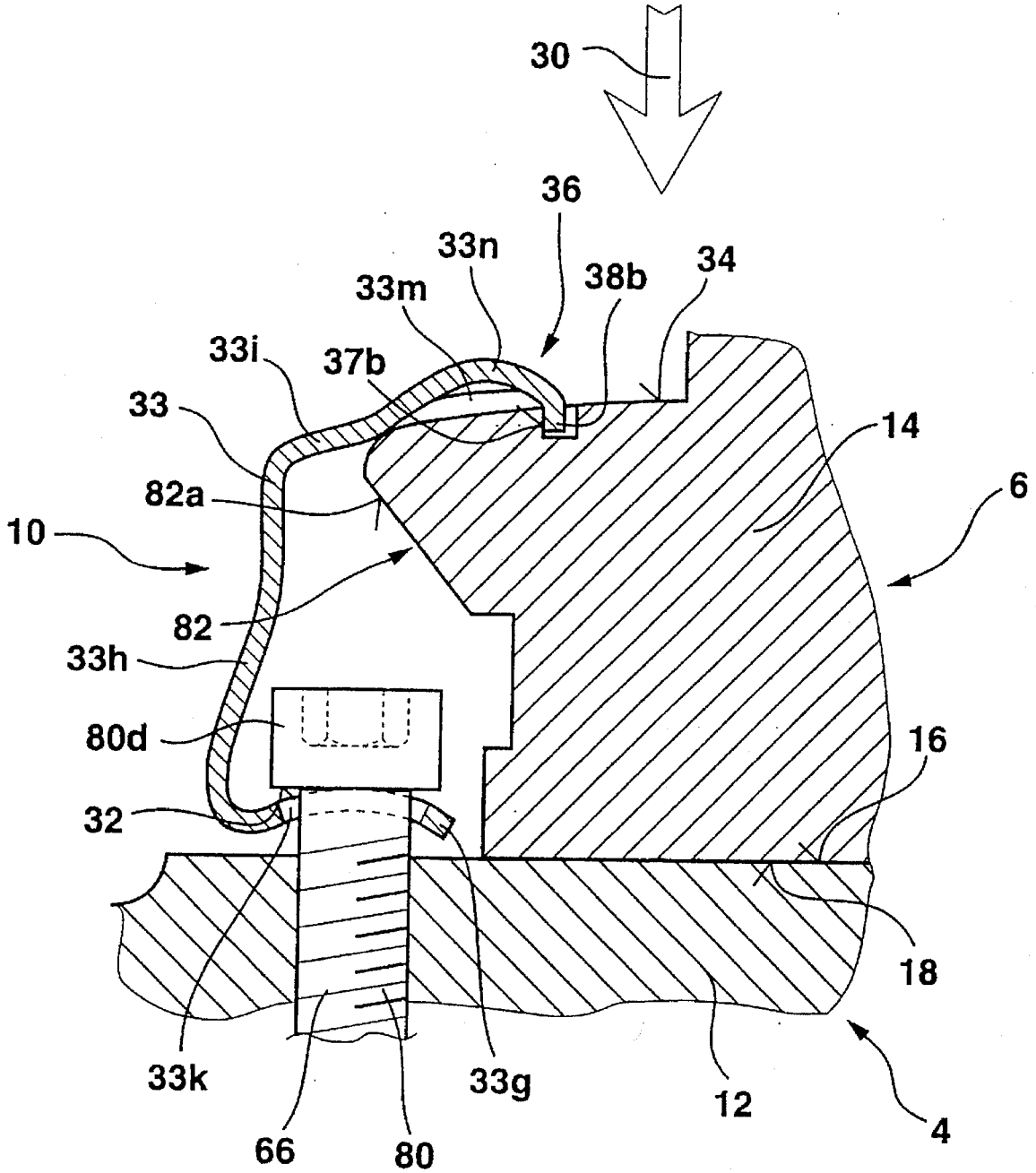

FIG. 22 shows a detail of FIG. 20. For the sake of greater simplicity, the region around the retaining element 33 is shown again in FIG. 22 on a different scale.

FIG. 22 shows the retaining element 33 in the fully mounted state.

Figure 23:
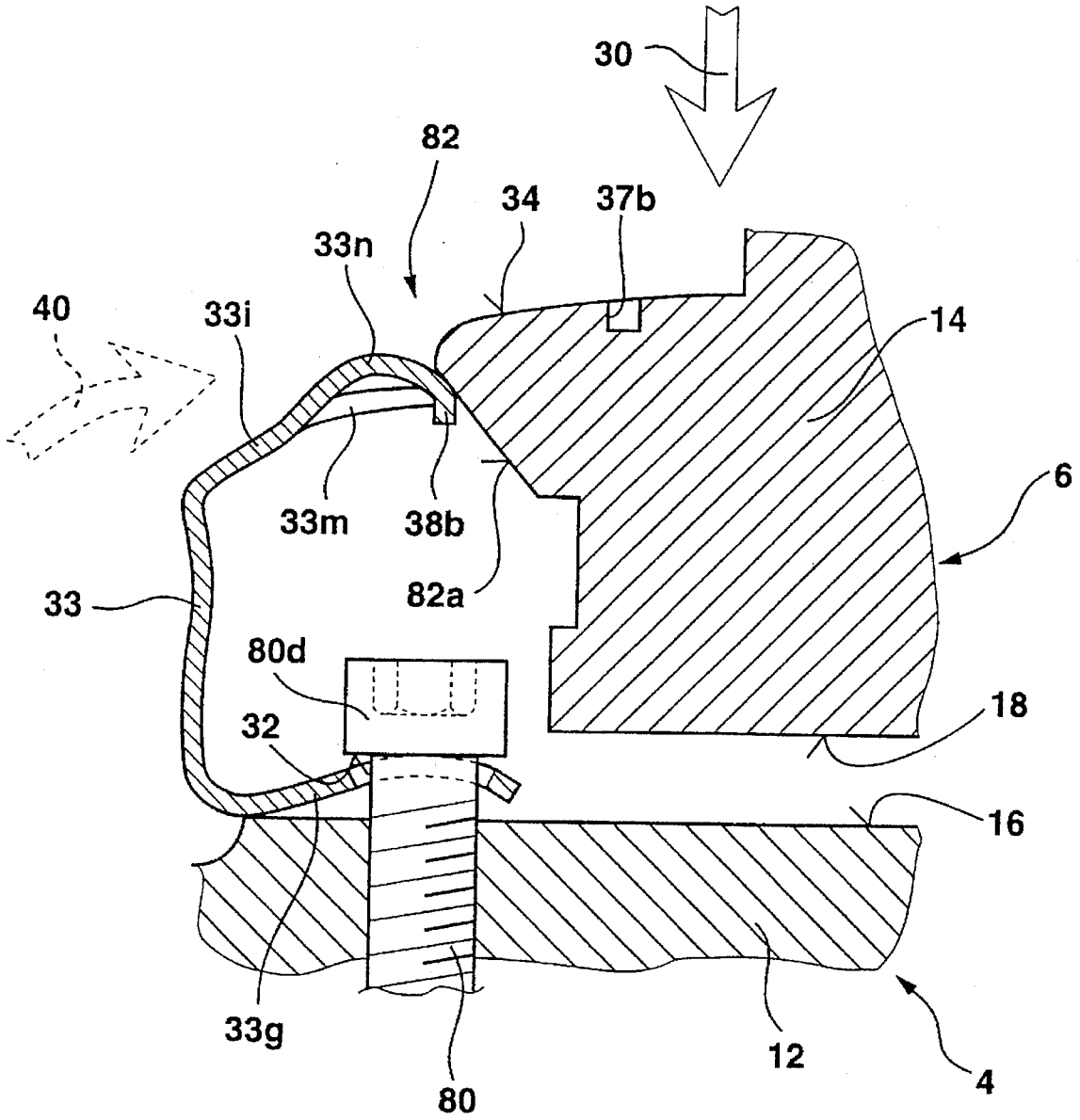

FIG. 23 shows the retaining element 33 while the intake module 6 is being attached to the cylinder head 2 of the engine 4, shortly before the intake module 6 reaches its final position.

Figure 24:
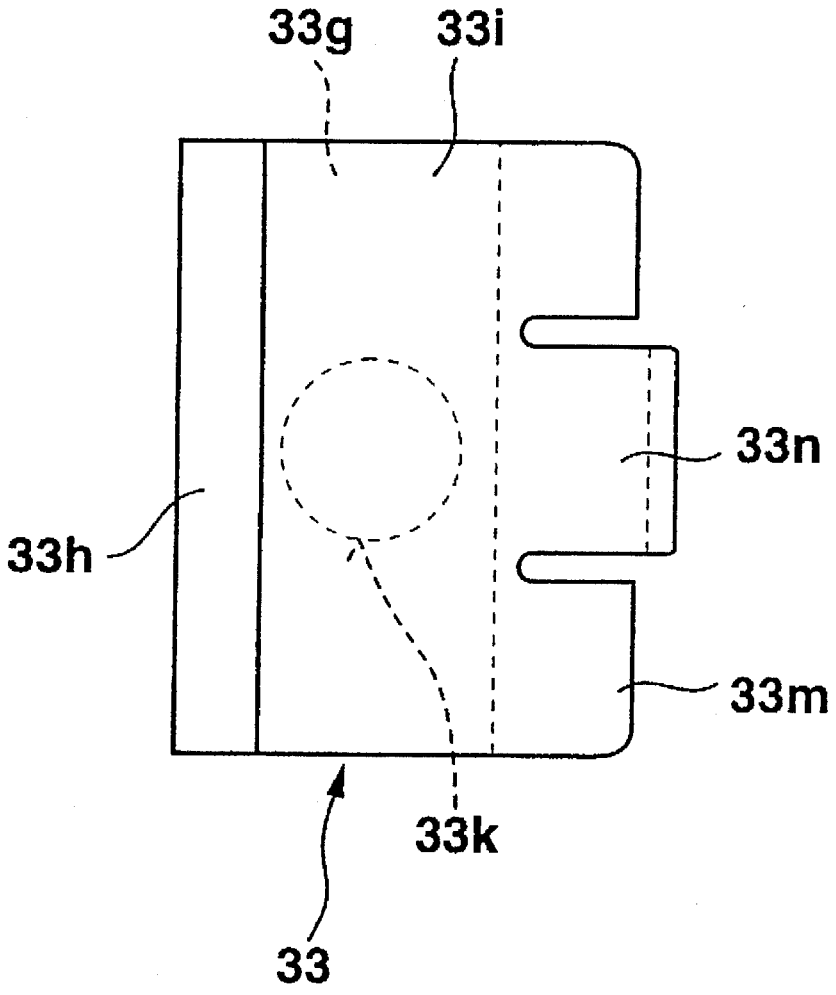

FIG. 24 shows the retaining element 33 as a detail in plan view. With respect to FIG. 22, FIG. 24 shows a view from above on the retaining element 33.

To make it easier to describe the retaining element 33, the retaining element 33 will be broken down in the following description into one region having a lower leg 33*g*, one bridge 33h, and one upper leg 33i. There is a hole 33k in the lower leg 33g. On the upper leg 33i, a retaining tab 33m and a securing tab 33n are provided. Selectively, a plurality of tabs 33m and/or 33n may be provided on each leg 33i.

In this exemplary embodiment as well, the bolt 80 is screwed into the cylinder head 2. The bolt 80 serves as the stop piece 66, also called the engine stop piece 66, already mentioned, on which the retention face 32 or engine retention face 32 pointing in the retention direction 30 is provided. The engine retention face 32 is located on the underside of the bolt head 80d. The bolt 80 may be embodied for instance as described in conjunction with FIG. 4. Alternatively, as shown for instance in FIG. 20, the bolt may be a commercially available screw.

The diameter of the hole 33k is smaller than the diameter of the bolt head 80d. With the bolt 80, the retaining element 33 is firmly held on the engine 4. As FIG. 22 shows, the retaining element 33 is firmly held with the bolt 80 in such a way that the retaining element 33 is somewhat pivotable in the region of the bolt 80. Because of the pivotability of the retaining element 33, when the intake module 6 is mounted on the engine 4 the retaining element 33 need not be bent, or is bent only insignificantly. The situation correspondingly true when the intake module 6 is removed from the engine 4. However, it is also possible to modify the exemplary embodiment in such a way that the lower leg 33d of the retaining element 33 is screwed firmly and nonpivotably to the cylinder head 2 of the engine 4 with the aid of the screw or bolt 80. By suitable dimensioning and a suitable choice of materials, it can be assured that the bending of the retaining element 33 occurring during mounting or dismantling does not cause damage to the material.

The underside of the bolt 80d pointing in the retention direction 30 acts as the engine retention face 32, on which the retaining element 33 is braced with its lower leg 33g. On the intake module 6, there is a surface, called the counterpart retention face 34 or intake module retention face 34, which extends crosswise to the retention direction 30 or is slightly inclined relative to the retention direction 30. The retaining tab 33m of the retaining element 33 presses against the intake module retention face 34 in the retention direction 30 (FIG. 22).

A retention edge 37b is located in the region of the intake module retention face 34, and a retention protrusion 38b is provided on the fastening tab 33n (see FIG. 22). The retention edge 37b and the retention protrusion 38b are adapted to one another such that in the mounted state these two parts 37b, 38b mesh with one another and act as a securing means 36. The securing means 36 assures that even under a major shaking strain, the retaining element 33 cannot slip off the intake module retention face 34.

To make dismantling easier, the securing tab 33n of the retaining element 33 can for instance be shaped preferably such that an interstice is created between the securing tab 33n and the retention face 34 of the intake module 6, so that with a simple tool the securing means 33 can be undone and the upper leg 33i moved by lever action away from the intake module 6.

In FIGS. 20, 22 and 23, a mounting or assembly aid 82 is shown. To that end, there is a chamfer 82a on the flange 14 of the intake module 6. The chamfer 82a is part of the assembly aid 82. The chamfer 82a is placed obliquely, by approximately 10° to 70°, relative to the retention direction 30. When the intake module 6 is mounted on the engine 4, the end of the upper leg 33i remote from the bridge 33h comes into contact with the chamfer 82a, shortly before the intake module 6 reaches the intended final position. As a result, upon further motion of the intake module 6 in the retention direction 30, the upper leg 33i is moved to the side (to the left in terms of FIG. 23). As soon as the end of the upper leg 33i remote from the bridge 33h has moved past the rounded edge between the chamfer 82a and the intake module retention face 34, the upper leg 33i snaps into its retaining position (to the right in terms of FIG. 23). As a result, the retaining tab 33m enters into operative engagement with the intake module retention face 34, thus achieving a prefixation of the intake module 6. With a suitable closing device, the retaining element 33 is then moved in the closing direction 40 (FIG. 23), until the retention protrusion 38b is in operative engagement with the retention edge 37b. By means of this slip-on procedure, the requisite retention force is achieved between the engine 4 and the intake module 6.

FIG. 21 shows that the retaining element may also be provided with a plurality of retaining tabs. In FIG. 21, this cohesive retaining element is identified by reference numeral 33z. The cohesive retaining element 33z is braced against a plurality of engine retention faces 32 and a plurality of intake module retention faces 34.

Figure 25:
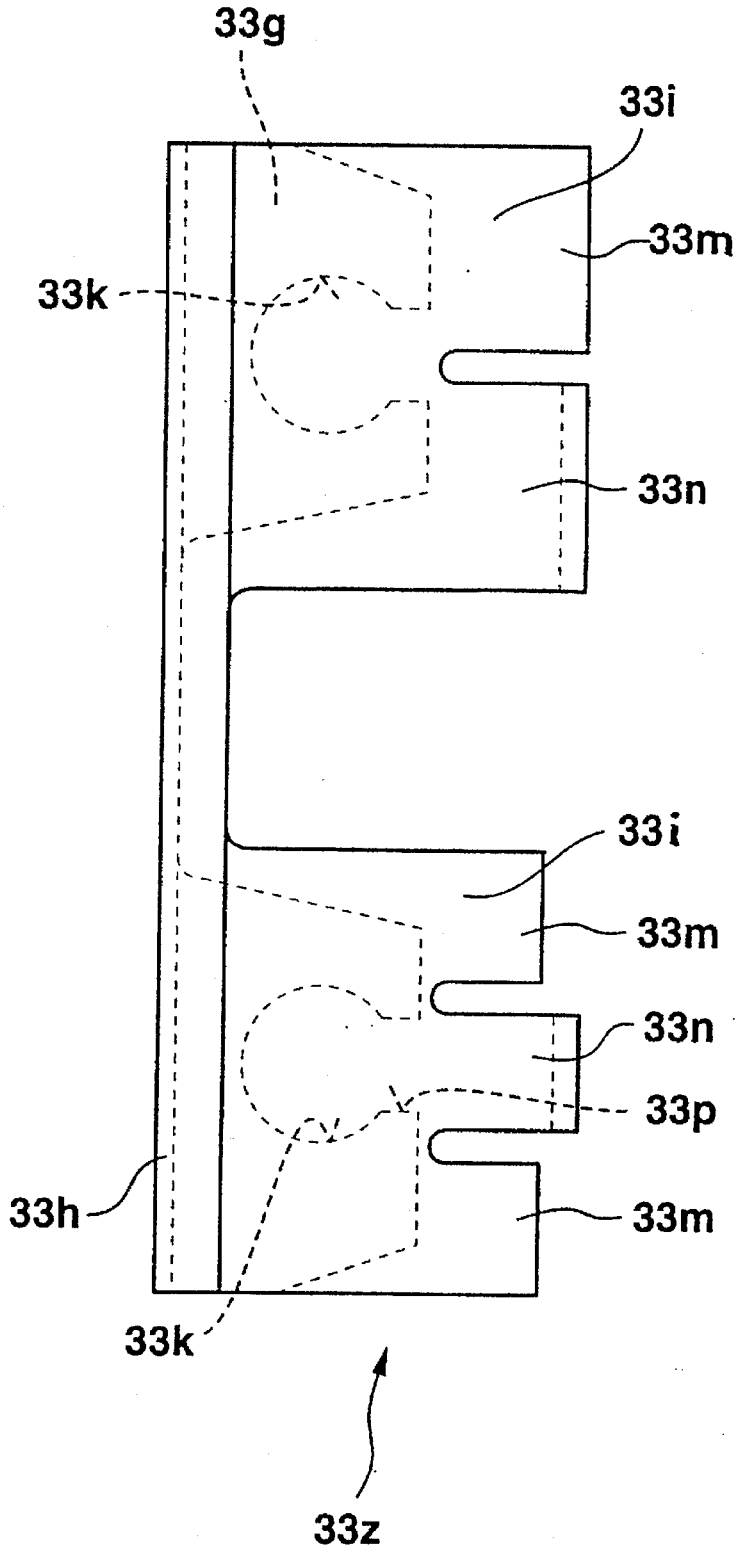
Figure 26:
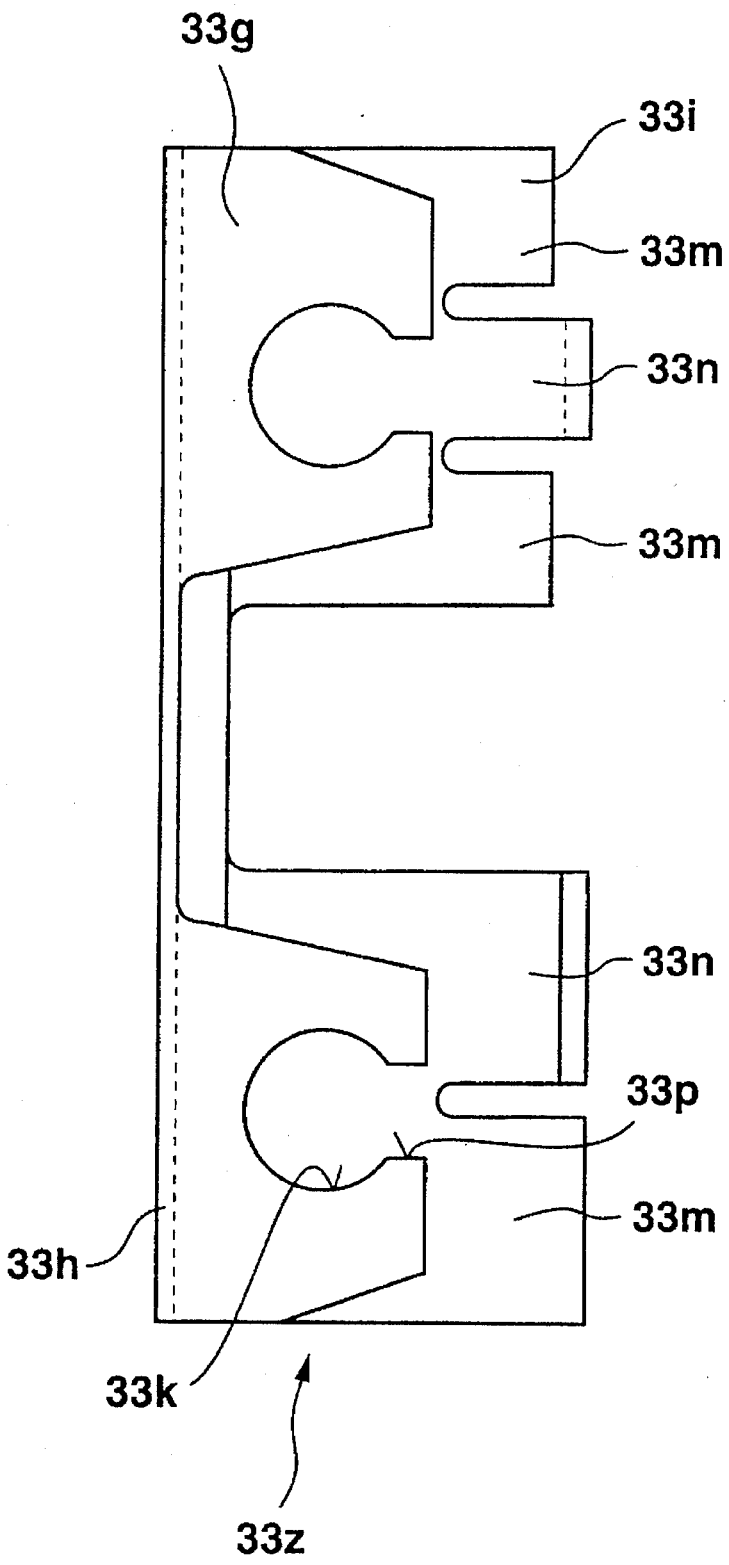

FIGS. 25 and 26 show a preferred advantageous embodiment of the retaining element 33z.

FIG. 25 is a plan view looking toward the upper leg 33i (a view from above in terms of FIG. 22), and FIG. 26 is a view from below looking toward the lower leg 33g (a view from below in terms of FIG. 22).

In the version of the retaining element 33z shown in FIGS. 25 and 26, two holes 33k for two bolts 80 are provided. In this retaining element 33z, there are two lower legs 33g and two upper legs 33i, with a total of three retaining tabs 33m and two securing tabs 33n. This is merely an example. The cohesive retaining element 33 may also have a smaller or larger number of upper and lower legs 33g, 33i and tabs 33m and 33n.

As needed, a slit 33p may be provided (FIGS. 25, 26). The slit 33p extends from the end of the lower leg 33g remote from the bridge 33h to the hole 33k. With the slit 33p, the retaining element 33 or 33z can be removed from or mounted on the engine 4, without requiring that the bolt 80 be entirely unscrewed for the purpose. To prevent the retaining element 33 or 33z from being able to slip off unintentionally, it is expedient optionally to choose to make the slit 33p very slightly smaller than the diameter of the bolt 80 in the region of the engine retention face 32.

In the exemplary embodiments shown, the engine retention face 32 and the intake module retention face 34 extend substantially crosswise to the retention direction 30. It is also possible, however, to position the two faces 32 and 34 somewhat obliquely relative to the retention direction 30 and/or to make the faces 32 and 34 curved or bent, as long as the retaining element 33 or 33z is prevented from slipping off by a stop or by the described securing means 36 or 78a.

By simple provisions, the retaining element 33 or 33z can be embodied such that it is highly elastic in the retention direction 30. Especially high elasticity is obtained particularly if the legs 33a, 33c, 33g, 33i or the bridge 33b or 33h are made as long as possible and/or are made to have a curved or bent course. The high elasticity of the retaining element 33 or 33z assures that even in the event of settling in the region of the fastening of the intake module 6 to the engine 4, the initial tension or spring force is preserved, even under major oscillatory strain.

In contrast to a construction in which the intake module 6 should have to be fastened to the engine 4 with the aid of one or more fastening screws, it is not necessary in our invention to engage the screw of a fastening screw directly with a tool when mounting or dismantling the intake module 6. In the subject of the present invention, the retaining element 33 or 33z may be embodied such that the mounting or dismantling can be done by means of a linear or at most somewhat curved displacement or slight pivoting of the retaining element 33 or 33z.

By means of the linear or substantially linear displacement of the retaining element 33 or 33z, it is possible in the event of very poor accessibility to provide an extension, running crosswise to the retention direction 30, on the retaining element 33 or 33z, on which extension the retaining element 33 or 33z can be displaced in the closing direction 40 (for mounting) or counter to the closing direction 40 (for dismantling), for instance with slight blows of a hammer or with the aforementioned closing device.

In conjunction with present exemplary embodiments, it has been described how the retaining element 33 or 33z is braced against the intake module 6 via the intake module retention face 34 and against the engine 4 via the engine retention face 32. It is possible to provide the kind of bracing against the intake module 6 described against the engine 4 instead, and in its place to provide the kind of bracing against the engine 4 against the intake module 6 instead. In other words, the two types of bracing are transposed.

Figure 27:
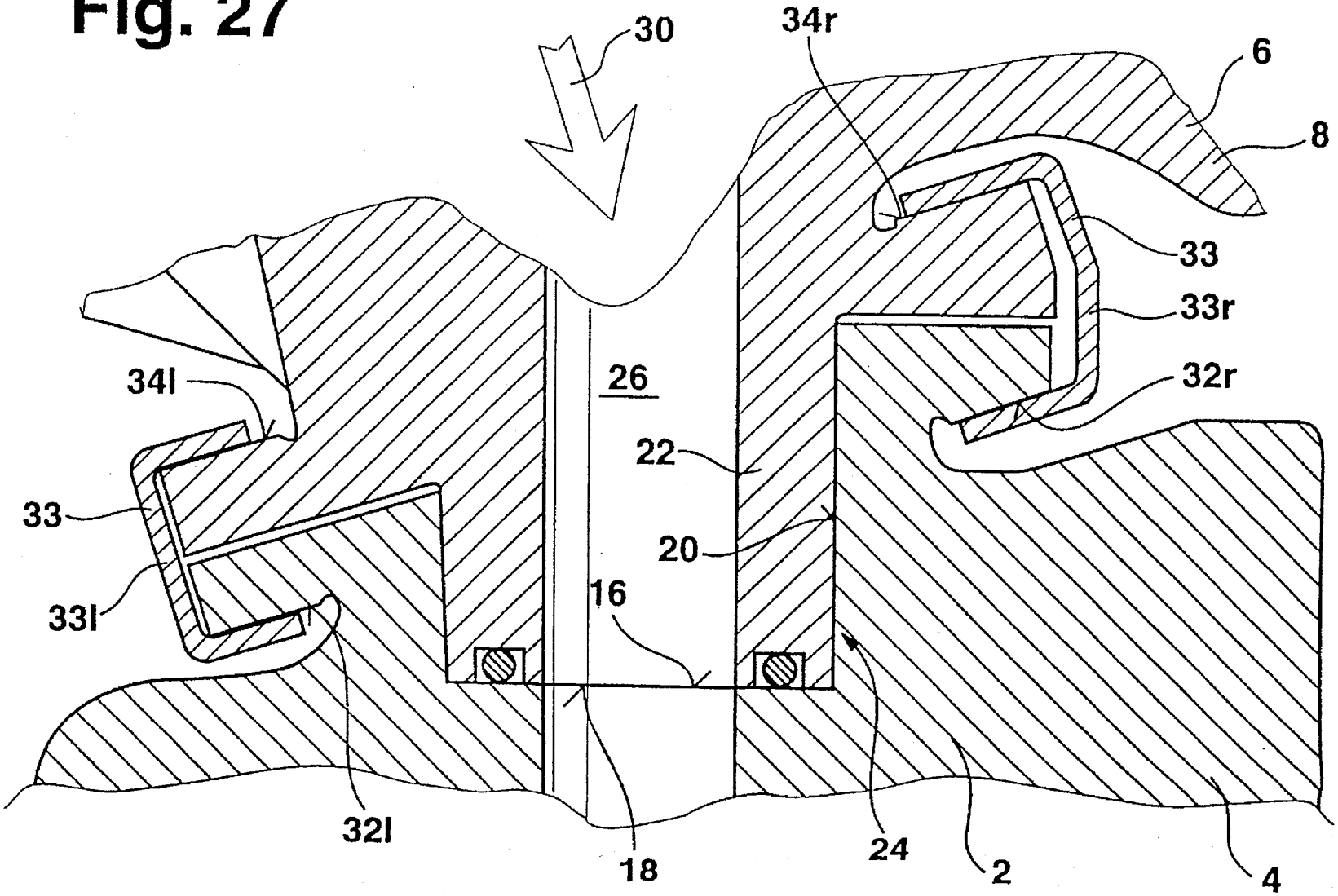
Figure 28:
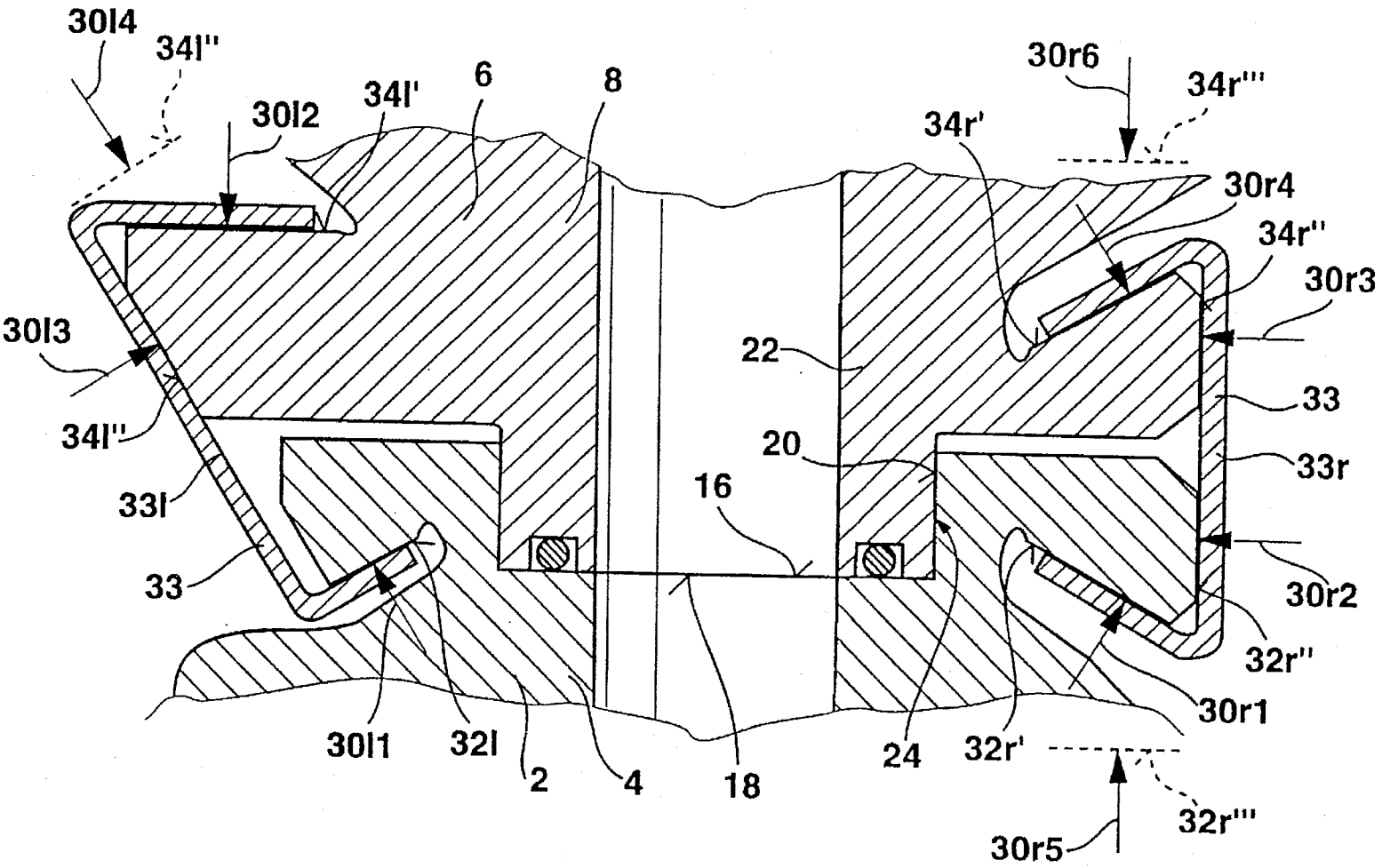

FIGS. 27 and 28 show further exemplary embodiments; the section shown is chosen such that differently embodied retaining elements can be shown in the various cross sections. For the sake of simplification in describing the exemplary embodiments, a portion shown on the left in the drawing is identified additionally by the letter "1". Correspondingly, the reference numerals on the right-hand side are followed by the letter "r". That is, the left-hand retaining element is marked **33*l* and the right-hand retaining element is marked 33*r*. The same is true for the faces 32 and 34. The retention face 32, also called the engine retention face 32, is assigned reference numeral 321 on the left-hand side and 32*r* on the right. The counterpart retention face 34, also called the intake module retention face 34, is called 34*l* on the left and 34*r* on the right. Correspondingly, in FIG. 28, the retention directions relating to the left-hand portion of the drawing are assigned reference numeral 30*l*, and the retention directions relating to the right-hand portion of the drawing are assigned reference numeral 30*r*. In FIGS. 27 and 28, the securing means 36 shown for instance in FIG. 2** is not shown, for the sake of simplicity.

In the exemplary embodiment shown in FIG. 27, the flange faces 16 and 18 do not extend parallel to the faces **32*l*, 32*r*, 34*l*, 34*r*. On the assumption that friction can be ignored between the retaining element 33*l* or 33*r* and the corresponding faces 32*l*, 32*r*, 34*l*, 34*r*, the legs of the retaining elements 33*l*, 33*r* act vertically on the corresponding faces 32*l*, 32*r*, 34*l*, 34*r*. Since the retention faces 32*l*, 32*r* and the counterpart retention faces 34*l*, 34*r* are parallel to one another, the result is that the retention direction 30 extends in the same direction for both retaining elements 33*l*, 33*r*, which is represented in FIG. 27 by the arrow 30**.

Since the retention direction 30 does not extend at right angles to the flange faces 16, 18, the retaining elements **33*l*, 33*r* effect a vectorial distribution of force in the region of the flange faces 16, 18 and protrusion 22. One vectorial component of the force acts between the two flange faces 16 and 18, and one component of the force acts in the region of the guide 24 between the turned groove 20 and the protrusion 22**.

Depending on the direction from which they are observed, various retention directions arise in the exemplary embodiment shown in FIG. 28. For the sake of simplifying the description, these retention directions are marked **30*l*1, 30*l*2, 30*l*3, 30*l*4 on the left-hand side and 30*r*1–30*r*6** on the right-hand side.

With friction ignored, the lower leg of the left retaining element **33*l* acts vertically, that is, at right angles, on the obliquely located retention face 32*l*. This direction is represented in FIG. 28 by an arrow 30*l*1 and is called the retention direction 30*l*1. In FIG. 28, there are a counterpart retention face 34*l*' extending parallel to the flange faces 16, 18 and a counterpart retention face 34*l*" extending obliquely. Ignoring friction, the retaining element 33*l* acts vertically upon the counterpart retention face 34*l*' in the direction of the arrow 30*l*2 and upon the counterpart retention face 34*l*" in the direction of the arrow 30*l*3. The force in the direction 30*l*2 and the force in the direction 30*l*3 can be combined vectorially into an operative force in the direction of the arrow 30*l*4. The arrow 30*l*4 and the force in the direction 30*l*1 extend in a line. The vectorially combined effective force acting in the direction of the arrow 3*l*4 can be thought of as if this force were to act upon an imaginary effective counterpart retention face 34*l*'" replacing the two counterpart retention faces 34*l*' and 34". The imaginary effective counterpart retention face 34'" is suggested in symbolic fashion by dashed lines in FIG. 28. Since the flange faces 16, 18 do not extend at right angles to the direction 30*l*1 and 30*l*4, respectively, the retaining element 33*l* in FIG. 28 has the effect that the protrusion 22 is braced not only against the flange face 16 but also crosswise to it on the turned groove 20**.

On the right-hand side in FIG. 28, the retaining element **33*r* is branched on one retention face 32*r*' and on one retention face 32*r*". On the side of the intake module, the retaining element 33*r* is braced against one counterpart retention face 34*r*' and one counterpart retention face 34*r*". The directions of the forces of the retaining element 33*r* that act upon the faces 32*r*', 32*r*", 34*r*', 34*r*" are indicated symbolically in FIG. 28 by four arrows 30*r*1, 30*r*2, 30*r*3, 30*r*4. The force in the direction 30*r*1 can be broken down vectorially into one force parallel to the direction 30*r*2 and one force at right angles to the direction 30*r*2. This last vectorially broken-down effective force is symbolically represented in FIG. 28 by an arrow 30*r*5. On the side of the intake module 6, the force in the direction 30*r*4 can be broken down by vectorial decomposition into an effective force oriented in the direction of the arrow 30*r*6. The direction of the effective force 30*r*6 is in one line with the direction of the arrow of the effective force 30*r*5. The force component in the direction of the arrow 30*r*5 acts upon an imaginary effective retention face 32'" extending at right angles to it and suggested in FIG. 28 by a dashed line. Correspondingly, the force in the direction of the arrow 30*r*6 acts upon an imaginary effective counterpart retention face 34*r*'"** shown in dashed lines.

It can be stated that, at least with a suitable mode of observation also taking into account vectorial forces and effective substitute faces, the retaining element **33*l* or 33*r* in the exemplary embodiment shown in FIG. 28 as well, in the mounted state, on the one hand engages a (real or imaginary) effective retention face 32*l* or 32*r*'" associated with the engine 4 and on the other engages a (real or imaginary) effective counterpart retention face 34*l*'" or 34*r*'" associated with the intake module 6 or the intake tube 8; the (real or imaginary) effective counterpart retention face 34*l*'" or 34*r*'"** points in the opposite direction from the (real or imaginary)

effective retention face 32*l* or 32*r*'". Correspondingly, the (real or imaginary) effective forces that are exerted by the retaining element 33*l* or 33*r* on the faces point in opposite directions from one another.

In the above observations, it has been assumed that no friction occurs between the retaining element 33, 30*l*, 33*r* and the corresponding faces on which the retaining element 33, 33*l*, 33*r* is supported. If friction occurs, the directions of the corresponding forces changes somewhat, depending on the magnitude of the frictional force. Nevertheless, the direction of the forces is at least substantially as stated in conjunction with the exemplary embodiments.

In the exemplary embodiment of FIG. 28 as well, the retention faces 32*l*, 32*r*', 32*r*" and counterpart retention faces 34*l*', 34*l*", 34*r*', 34*r*" can be located on existing cams, similar to the cams 72, 72', 72", 72'" shown in FIGS. 6, 7*a*, 7*b*. During mounting or dismantling, the retaining element 33*l*, 33*r* is displaced substantially linearly, at right angles to the sectional plane of FIG. 28. As a result, the retaining element 33*l*, 33*r* can also be provided at locations that are not accessible to fastening screws.

Just as, in the exemplary embodiments shown in FIGS. 27 and 28, the retention face 32 or engine retention face 32 and the counterpart retention face 34 or intake module retaining element 34 need not extend parallel to one another or parallel to the flange faces 16, 18, it is equally possible in all the other exemplary embodiments for the retention face 32 and the counterpart retention face 34 to extend at an angle from one another and at an angle from the flange faces 16, 18.

In the preferred selected exemplary embodiments, the retaining element 33, 33*z* is elastic, and preferably is elastically relatively soft, and the flanges 12, 14 are relatively rigid. It should be noted that one may also modify the invention such that the retaining element 33, 33*z* is embodied as relatively rigid and instead the retention face 32 and/or the counterpart retention face 34 is elastically relatively highly yielding. This modification can be attained for instance providing that the flange 12 and/or the flange 14 and/or the stop piece 66 and/or the counterpart stop piece 70 and/or the bolt 80 is or are embodied as elastically relatively soft.

The foregoing relates to preferred exemplary embodiments of the invention, it being understood that other variants and embodiments thereof are possible within the spirit and scope of the invention, the latter being defined by the appended claims.

What is claimed and desired to be fastened by Letters Patent of the United States is:

1. An internal combustion engine with an intake module or intake tube, wherein the intake module or intake tube is fastened to the engine by a fastening means (10) in a retention direction (30), the fastening means (10), includes at least one retaining element (33, 33*z*) that is under spring force in a mounted state and that is braced on one side on at least one retention face (32) associated with the engine (4) and oriented substantially in a direction of the retention direction (30) and on another side on at least one counterpart retention face (34) associated with the intake module (6) or intake tube and oriented substantially counter to the retention direction (30).

2. The engine in accordance with claim 1, in which the retaining element (33, 33*z*) is braced against a plurality of retention faces (32) associated with the engine (4).

3. The engine in accordance with claim 1 in which the retaining element (33, 33*z*) is braced against a plurality of counterpart retention faces (34) associated with the intake module (6) or intake tube.

4. The engine in accordance with claim 2 in which the retaining element (33, 33*z*) is braced against a plurality of counterpart retention faces (34) associated with the intake module (6) or intake tube.

5. The engine in accordance with claim 1, in which the retaining element (33, 33*z*) is an elastic element.

6. The engine in accordance with claim 1, in which the spring force arises by means of a displacement of the retaining element (33, 33*z*) oriented substantially crosswise to the retention on direction (30), and in particular by a substantially linear displacement of the retaining element (33, 33*z*).

7. The engine in accordance with claim 1, in which the retaining element (33, 33*z*) has an approximately U-shaped or bracketlike cross section, at least in one portion.

8. The engine in accordance with claim 1, in which when the intake module (6) or intake tube has been removed from the engine (4), the retaining element (33, 33*z*) is coupled to the intake module (6) or intake tube.

9. The engine in accordance with claim 1, in which when the intake module (6) or intake tube has been removed from the engine (4), the retaining element (33, 33*z*) is coupled to the engine (4).

10. The engine in accordance with claim 1, in which the retention face (32) is provided on a stop piece (66) associated with the engine (4).

11. The engine in accordance with claim 10, in which the stop piece (66) is a bolt (80).

12. The engine in accordance with claim 1, in which the counterpart retention face (34) is provided on a counterpart stop piece (70) associated with the intake module (6) or intake tube.

13. The engine in accordance with claim 1, in which at least one chamfer (76) associated with the engine (4) is provided, said at least one chamfer is made in such a way that once the intake module (6) or intake tube has been mounted on the engine (4), the spring force is generated by a displacement of the retaining element (33, 33*z*), by means of a substantially linear displacement of the retaining element (33, 33*z*).

14. The engine in accordance with claim 1, in which at least one chamfer (76) associated with the intake module (6) or intake tube is provided, said at least one chamfer is made in such a way that once the intake module (6) or intake tube has been mounted on the engine (4), the spring force is generated by a displacement of the retaining element (33, 33*z*), by means of a substantially linear displacement of the retaining element (33, 33*z*).

15. The engine in accordance with claim 1, in which at least one chamfer (76) associated with the retaining element (33, 33*z*) is provided, said at least one chamfer is made in such a way that once the intake module (6) or intake tube has been mounted on the engine (4), the spring force is generated by a displacement of the retaining element (33, 33*z*), by means of a substantially linear displacement of the retaining element (33, 33*z*).

16. A method for fastening an intake module or intake tube to an internal combustion engine, wherein the intake module or intake tube, fastening said intake module or intake tube by a fastening means (10) against the engine in a retention direction (30), orienting at least one retention face (32) associated with the engine (4) in a retention direction (30), and orienting at least one counterpart retention face (34) associated with the intake module (6) or intake tube substantially counter to the retention direction (30)

wherein the fastening means (10) includes at least one retaining element (33, 33*z*), and the intake module (6) or intake tube is moved substantially crosswise to the retention direction (30) to fasten the intake module (6) or intake tube to the engine.

17. The method in accordance with claim 16, in which the retaining element (33, 33*z*) is moved substantially linearly.

* * * * *